United States Patent [19]

Gallant et al.

[11] Patent Number: 4,646,211

[45] Date of Patent: Feb. 24, 1987

[54] SERVICE OUTLET WALL AND RAIL SYSTEM FOR USE THEREON

[75] Inventors: Dennis J. Gallant, Cincinnati, Ohio; Eugene H. Fullenkamp, Batesville, Ind.

[73] Assignee: Hill-Rom Company, Inc., Batesville, Ind.

[21] Appl. No.: 672,434

[22] Filed: Nov. 19, 1984

[51] Int. Cl.[4] ..... F21S 3/00

[52] U.S. Cl. ..... 362/149; 362/220; 362/801; 339/23; 339/101; 312/223; 174/49; 137/360

[58] Field of Search ..... 362/145, 147, 149, 219, 362/220, 226, 368, 432, 801; 339/20, 21 R, 23, 21 S, 24, 101; 174/48, 49; 220/4 R; 312/209, 245, 223; 137/360, 361

[56] References Cited

U.S. PATENT DOCUMENTS

| | | | |
|---|---|---|---|
| 3,200,244 | 8/1965 | Meyer | 174/48 |
| 3,462,892 | 8/1969 | Meyer | 52/28 |
| 3,567,842 | 3/1971 | Meyer | 174/48 |
| 3,692,920 | 9/1972 | Santarelli | 174/48 |
| 3,699,235 | 10/1972 | Wasson et al. | 174/48 |
| 3,836,937 | 9/1974 | Donato | 339/21 R |
| 3,931,452 | 1/1976 | Nilsson | 174/48 |
| 4,017,137 | 4/1977 | Parks | 339/21 R |
| 4,135,775 | 1/1979 | Driscoll | 339/23 |
| 4,277,123 | 7/1981 | Haworth et al. | 339/22 R |
| 4,338,485 | 7/1982 | Fullenkamp et al. | 174/48 |
| 4,475,322 | 10/1984 | Russo et al. | 312/209 |

OTHER PUBLICATIONS

Intensive Care EI, 3/91, (1 Page).
Intensive Care EI 3E, p. 13, (1 Page).
Elayo Gas System, (2 Pages).
Fairfield Oxygen & Air Flowmeters & Accessory Block Assemblies, (2 Pages).
Straight Ceiling Gas Track & Curved Ciling Gas Track, (4 Pages).
Coherent Structures Hardward, (3 Pages).
"Rail System for Intensive Care Stations" (1 Page & Translation).
"Disinfection of Apparatus in Aseptor" (1 Page & Translation).
"VCH-3 Adjustable Modular System" (13 Pages & Translation).

*Primary Examiner*—Charles J. Myhre
*Assistant Examiner*—David A. Okonsky
*Attorney, Agent, or Firm*—Brian J. Leitten; F. Kristen Koepcke

[57] ABSTRACT

A service outlet wall comprising at least one generally planar wall member, at least one section of which is adapted to receive one or more service outlets having a service conduits connected thereto and leading to service sources is disclosed. Means for housing the conduits is provided. The housing means is adjacent to the linear sections of the wall member and is configured to conceal and protect the service conduit. The service outlets are movable along the linear sections of the wall member, permitting placement of the service outlets at different positions along the linear sections. The service conduits connected to the outlets are simultaneously repositioned while maintaining the conduits in a concealed and protected position. A rail system for providing service outlets to particular locations in a room while simultaneously positioning service conduit connected to the outlets is also disclosed.

80 Claims, 26 Drawing Figures

SERVICE OUTLET WALL AND RAIL SYSTEM FOR USE THEREON

BACKGROUND AND OBJECTS OF THE INVENTION

The present invention relates to providing services and service outlets to rooms. In particular, the invention relates to providing patient-related services to patient-care rooms, such as are located in hospitals, nursing homes, and other medical facilities requiring that certain services being continuously available for use in connection with patient treatment. For example, a supply of gaseous oxygen and nitrogen, electrical outlets, room lighting, nurse-call intercom, patient monitoring devices and patient convenience facilities are generally required to be available adjacent the patient bed area. It is customary to provide the services directly to the room wall adjacent the patient bed, or to centralize such services at headwall units which mount in the interior of a room against a room wall.

While various attempts have been made to conveniently orient a variety of services for access by a patient or a doctor, nurse or other medical personnel, these attempts have been deficient in one or more aspects and have generally been an unsatisfactory manner of providing patient-care services. Furthermore, past systems for providing patient-care services have generally resulted in dedication of a particular room or location to a specific type of patient care. For example, once a patient room has been configured for general medical-surgical use, with services required for providing the normal level of medical-surgical care being located adjacent the patient bed, it has been difficult and time consuming to convert the orientation and type of patient-care services provided to allow the room or location to be employed for a different level of patient care, e.g., for progressive care, intensive or critical care, recovery or emergency use.

A significant difficulty of past attempts to provide patient-care services has been the inflexibility of the systems. In many instances, patient-care services have been provided at fixed locations. For example, patient-care service outlets have been permanently or fixedly attached in a room wall or in a mounted headwall unit. In such a system, the outlet location cannot be quickly reoriented to adjust to changing patient or hospital needs.

With past attempts to provide fixed patient-care services, if specific patient conditions or special procedures require the addition of, e.g., medical gases, or if it is necessary to relocate patient service outlets or devices to the other side of the patient bed for a particular procedure or procedures, the flexibility necessary to accomplish this is absent. Further, with fixed service outlets, it may not be possible to properly engage secondary devices, e.g., secondary regulators and flow meters, employed in certain procedures in connection with particular patient-care services. In addition, changes in the size and shape of various patient-care service devices employed in typical patient treatment situations will often render the fixed service outlet locations unusable and require major reconstruction of the room wall or of the headwall unit. For example, newer equipment may be physically wider or taller than the original devices replaced, requiring additional spacing between outlets. The fixed outlet will not accept adjacent devices, resulting in the inability to provide the necessary services to the patient.

Even attempts to provide services in a more flexible manner have suffered from serious deficiencies. Most notably, attempts to provide services with movable outlets, typically mounted on a horizontal rail of some design, have required substantial exposure of patient-care service conduit to the room environment. Such exposure subjects both the patient and the medical personnel caring for the patient to increased risk of injury from leaking services and to increased risk of catching the patient bed, attachments to the bed, other patient-care equipment and persons themselves on the exposed service conduit. Service conduit used such past attempts has typically been flexible hose which hangs down, creating a ready trap for the unwary patient or the patient who is not fully oriented and for medical personnel. Exposed service conduit also increases the difficulty of quickly reorienting a particular service outlet or device or a plurality of such outlets or devices mounted on a single rail. Other flexible systems have placed hoses and service outlets in awkward, out of the way locations which are not readily accessible to service and which will not provide a support surface for movable outlets and devices.

No past attempts to provide patient-care services have resulted in a system which is completely flexible and which will permit immediate changes in the required level and extent of patient care. Further, no past systems have provided the flexibility required to incorporate changing levels of patient care as medical technology and research provide new and improved techniques.

It is therefore, an object of the present invention to provide a system for providing services to specific locations with substantially enhanced flexibility.

Another object of the present invention is to provide patient-care services to patient room environments with substantially greater flexibility than in the past.

Yet another object of the present invention is to provide a service outlet wall which permits positioning and support of at least one service outlet at different locations on the service outlet wall while simultaneously repositioning the service conduits which provide services to the service outlets, while maintaining the service conduits in a concealed and protected condition. A further object of the present invention is to provide a rail system for positioning service outlets in particular locations in a room while simultaneously positioning the service conduits connected to said outlets and while concealing and protecting said service conduits during and after repositioning.

SUMMARY OF THE INVENTION

These and other objects are achieved by the present invention, which is directed to a vertical service outlet wall comprising at least one generally planar wall member. At least one section of said generally planar wall member is adapted to receive and support at least one service outlet. At least one service conduit is connected to the outlet and to a service source.

Means for housing the conduit or conduits is provided, the housing means being adjacent to the linear section or sections of the wall member and being configured to conceal and protect the service conduits. The service outlet or outlets are movable along the linear sections of the wall member. This permits placement of the service outlet or outlets at different positions along the linear sections. As the outlet or outlets are positioned in particular locations, the service conduit or conduits connected to a particular outlet are simultaneously repositioned while maintaining the conduits in a concealed and protected position. The service outlet wall may be employed alone or in connection with one or more headwall units. The service outlet wall may be configured, e.g., as an island or as a pennisula. The full gamut of services required, e.g., in a patient-care environment, are provided by the service outlet wall.

The present invention also contemplates a rail system for providing service outlets to a particular location in a room while simultaneously positioning service conduit connected to the outlets. At least one support section on the rail system is configured to receive one or more service outlets and means for housing service conduit connected to the service outlet or outlets is provided adjacent the support section of the rail system. The housing means is configured to conceal and protect the conduit when the service outlets and attached conduit are simultaneously positioned along the support section. The rail system is adapted to be mounted on a support surface located in a room.

THE DRAWINGS

The objects and advantages of the present invention will become apparent from the following detailed description of the preferred embodiments thereof, in connection with the accompanying drawings in which like numerals designate like elements, and in which:

FIG. 12A shows the front panel on the vertical headwall unit in the open position, the top edge of the front panel being profiled to receive one or more service outlets.

DETAILED DESCRIPTION OF PREFERRED EMBODIMENTS OF THE INVENTION

Figure 1:
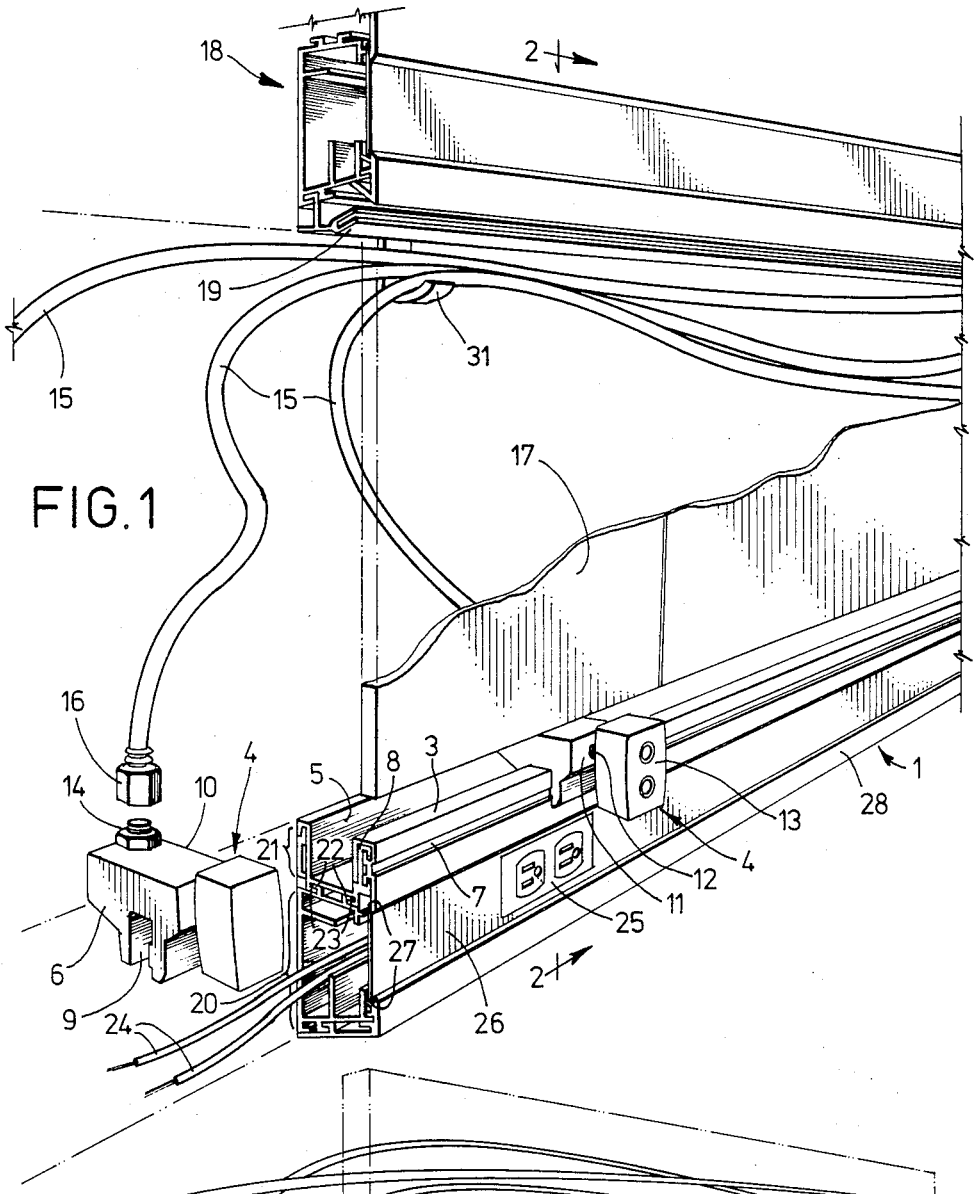
FIG. 1 is a perspective view of a service wall outlet according to a present invention.

In accordance with the present invention, there is provided a novel service outlet wall. The novel service outlet wall is principally composed of one or more horizontal rails that are mounted on a vertical room wall at specified levels. The rails function to provide means for ready placement and repositioning of services, e.g., medical gasses. The rails also provide channels for placement and retention of service conduit, e.g., electrical lines, and service outlets such as electrical plug sockets. The rails provide a physical stucture for supporting service devices.

The service outlet wall of the present invention is intended to be particularly useful in facilitating the providing of patient care. In a typical patient care environment, medical gases and a variety of electrical devices are employed. The number and type of services provided in a typical patient care environment varies depending on the specific nature of the patient care being provided. For example, in a general medical-surgical unit of a hospital or other patient care facility, a particular level of patient care is provided. More complex levels of patient care may be provided in environments designated as progressive patient care environments, intensive care environments, critical care environments, recovery units, emergency areas and other areas within the patient care facility. The novel service outlet wall of the present invention provides the ability to easily add or reduce the number of services required to provide the desired level of patient care with a minimum of down time, i.e., time when the patient care environment or room will be unavailable for its intended use. In this fashion, the typical patient care room can be quickly adjusted to handle additional patients, to handle patients requiring more complex care or to handle patients whose care needs vary over a period of time.

With the present invention, patient care service outlets may be added, subtracted or relocated to various positions with respect to the patient without exposing the service conduit connected to the service outlet. The service conduit is maintained in a concealed and protected condition.

The service outlet wall of the present invention comprises at least one generally planar vertical wall member. The wall member has at least one generally linear section which is adapted to receive at least one service outlet. At least one service conduit connecting the outlet to a service source is housed in the service outlet wall.

The housing means for the at least one service conduit is located adjacent the at least one generally linear section of the wall member and is configured to conceal and protect the service conduit. The service outlets are movable along the generally linear section of the wall member to permit placement of the service outlets at different positions along the linear section and the wall member. Simultaneously with movement of a service outlet along the linear section of the wall member to permit placement and support of the outlet at a different position along the section, the service conduit connected to the service outlet is repositioned within the housing and is maintained in a concealed and protected condition.

The at least one generally linear section of the wall member may comprise a horizontal opening in the wall positioned at a location intermediate the upper and lower ends of the vertical wall adapted to receive and support service outlets. The generally linear section may also comprise at least one rail having at least one generally linear support section on the rail configured to receive and support service outlets.

The service conduit housing means may be a trough located adjacent the support section of the opening or rail, or may preferable be an enclosed area adjacent the at least one rail or the back side of the vertical wall.

One embodiment of the present invention is shown in FIG. 1. In this embodiment, rail 1 is mounted on vertical wall 2. Rail 1 comprises a top guide edge 3 configured to receive the mating or guide portion 9 of one or more service outlets. Rail 1 further comprises a channel 5 configured to receive a tail portion 6 of service outlet 4. Top edge 3 of rail 1 comprises two sections. Cover member 7 is mated in some fashion with the front vertical wall 8 of the U-shaped channel 5. The cover member 7 and the front wall 8 comprise the top edge 3 of rail 1. Service outlets 4 are mounted on top edge 3 of rail 1 and are slideable along top edge 3.

For the purposes of this invention, top edge 3 may comprise a single unitary section, e.g., the front wall 8 of channel member 5. Channel member 5 may be of any convenient configuration designed to receive the tail portion 6 of outlets 4. Channel member 5 may be constructed of metal or plastic or any other appropriate material. Preferably, channel member 5 comprises an extruded aluminum channel. Cover member 7 may also be constructed of any suitable material. Preferably, cover member 7 is an extruded plastic member, e.g., poly vinyl chloride (PVC) and the extruded members which make up the rail may be manufactured by any appropriate extrusion technique. Cover member 7 also functions as an acoustic insulation member.

Service outlets 4 may be of any convenient configuration to provide the required service to the patient care environment. Typical of such service outlets is that shown in FIG. 1. Service outlet 4 comprises a tail section 6, a track-engaging section 9 and a main body member 10. The main body member 10 may contain a service outlet which can be connected directly to a patient service line or to a fitting 12 attached to an additional outlet 13 which extends away from the rail. Service oulet 4 also comprises a service conduit fitting 14. Preferably, this fitting is located on the tail section 6 of sevice outlet 4. Service outlets may be movable along the rails by hand or may be power-assisted in any suitable fashion. As used herein, the term "service outlet" is intended to mean any outlet, device, console or fixture including, e.g., gas, liquid, solid or power outlets as well as service devices employing said gases, liquids, solids or power. Specific examples of service outlets, including specific examples of the variety of service devices which may be employed in the invention, are described herein.

Service conduits 15 connect to service outlets 4 by fitting 16, which cooperates with service outlet fitting 14 in a connecting fashion. Service conduits 15 are maintained in a concealed and protected condition by housing means 17. In the embodiment shown in FIG. 1, housing means 17 is a panel. Panel 17 extends from just above the top of the main body portion of the service outlets 4 and encloses the service conduits 15 between wall 2 and the backside of panel 17. The panel 17 may be fixedly mounted or may be movably mounted in any suitable fashion. In the embodiment shown in FIG. 1, panel 17 is hingedly mounted to upper rail 18 at joint 19. Panel 17 pivots about a line formed along joint 19 from a generally vertical position in which panel 17 encloses service conduits 15 to a generally horizontal position in which service conduits 15 and wall 2 are exposed for access. Such access includes, e.g., regular system maintenance and system upgrading or change. Panel 17 may be constructed of any suitable material, e.g., metal, wood, plastic, fabric or foam, or may be configured as a frame constructed of, e.g., metal with a core or face material on the frame. The core or face material could be, e.g., a high pressure laminate bonded to steel, or a mineral fiber material with a vinyl covering. Panel 17 may be covered with any suitable covering material, e.g., paint, laminate material, fabric or the like.

In the embodiment shown in FIG. 1, a second rail 18 is provided above panel 17 and is located in a position parallel to rail 1. While not required, the upper portion of rail 18 as shown in FIG. 1 is essentially identical to the upper portion of rail 1. The lower portion of rail 18 is configured to receive and hold panel 17.

FIG. 1 also shows a lower rail portion 20. Lower rail portion 20 may be attached to wall 2 adjacent upper rail portion 21 or may be attached to upper rail portion 21 in a suitable fashion, e.g., by interlocking ears or members 22 and 23. Lower channel section 20 may be configured to receive a variety of services and/or service conduits. These services may be channeled through service conduits 24 to one or more outlets 25 mounted in face plate 26 of lower rail section 20. Faceplate 26 is attached in a suitable fashion to lower rail section 20. In the embodiment shown in FIG. 1, faceplate 26 is held in place by being positioned in channel 27 formed in lower rail section 20. Faceplate 26 may be constructed of any suitable material, e.g., metal, wood, plastic laminate and the like. A lower cover member 28 may also be employed in connection with this invention, providing a decorative appearance to the lower portion of rail 1. Cover member 28 may be constructed of any suitable material, e.g., metal, wood or plastic. Preferably, cover member 28 is an extruded PVC piece. In its preferred embodiment, cover member 28 is configured to slide onto ears 29 and 30 (shown in FIG. 2) of lower rail section 20. Lower cover member 28 forms a portion of lower rail section 20 when attached, and may be used to support panel member 26. Conduits 15 may be placed in an unsupported condition in the enclosed area formed by wall 2, panel 17 and upper rail 18, or they may be supported by a support member 31. This support member may comprise one or more hooks, dowels or other protrusions attached to wall 2, upper rail 18, the backside of panel 17 or to any other convenient support surface. Conduit 15 connected to service outlets 4 (outlets 4 are also referred to as rail blocks) is directed to support 31 and rests thereon. Where a plurality of service conduits are provided to the patient care environment, these conduits may rest on one or more such supports. From the supports, the conduits are directed to service supply sources.

In another embodiment of the present invention, one or more channels formed in lower rail section 20 may themselves function as service conduit to provide, e.g., a gas service to an outlet on face member 26. Thus, if it was desirable, e.g., to provide purified air to a patient requiring aseptic conditions surrounding the patient bed, purified air could be channeled to an outlet in rail 1 and ventilated in the direction of the patient bed adjacent the service outlet wall. In similar fashion, the service outlet wall could function as an air return.

Any number of patient-care support surfaces could be attached to rail 1, e.g., at the bottom of rail 1, in a fixed or movable manner. For example, a generally planar work surface (not shown) could be pivotedly attached to the bottom of rail 1 in a manner similar to the manner in which panel 17 is pivotedly attached to the bottom of upper rail 18. A linkage or positioning means (also not shown) could be employed to maintain the work surface in a generally horizontal position or in some other desired position for use by a patient-care personnel.

Figure 2:
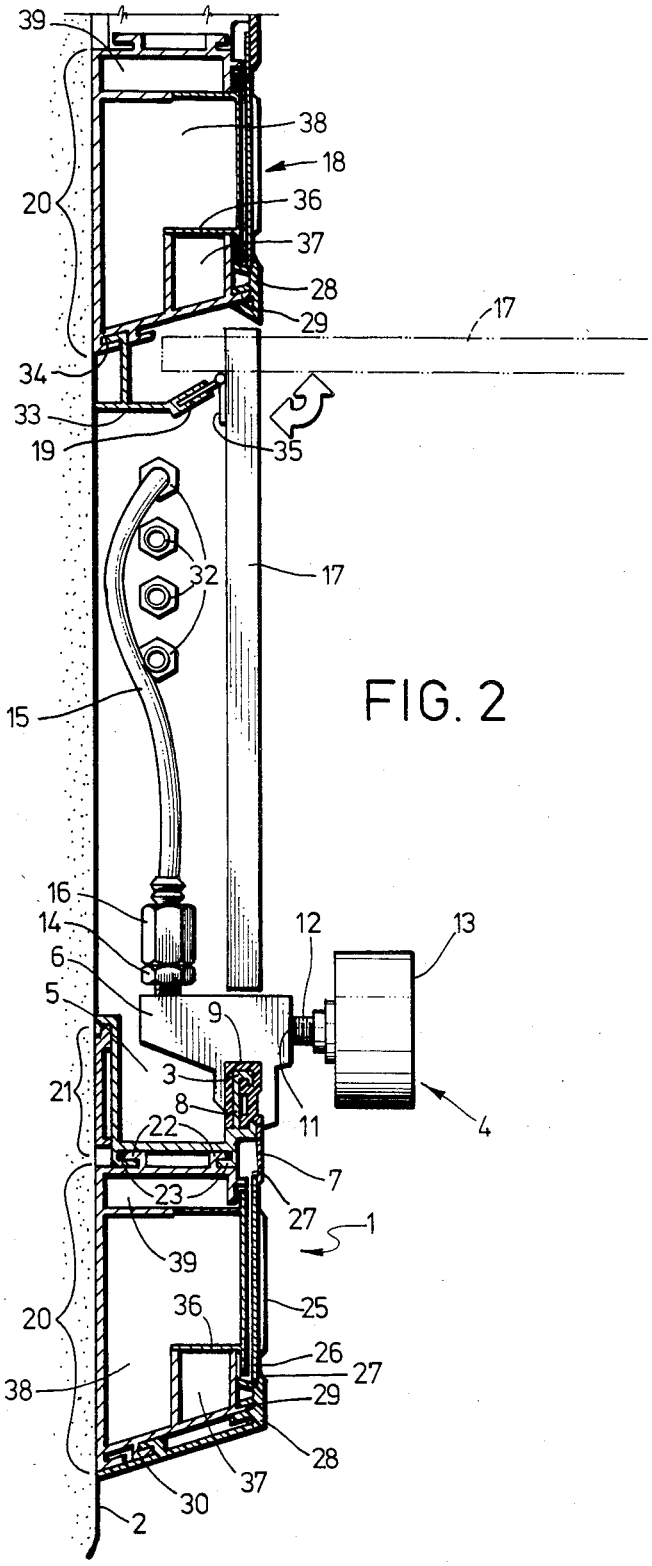
FIG. 2 is a section of a side elevational view of the service outlet wall shown in FIG. 1, taken along the line 2—2, and modified to show certain details.

FIG. 2 is a sectional view of the side elevation of the surface outlet wall shown in FIG. 1. This view has been modified to show certain details not shown in FIG. 1. FIG. 2 showed a series of hose fittings 32 to which service conduits 15, e.g., flexible hoses 15, are connected. These hose fittings may be connected on their other end to rigid piping or to a manifold block located, e.g., in a vertical headwall unit, or directly to a service supply source or to additional rigid or flexible service conduit leading to a service supply source. Panel 17 is hingedly mounted at 19 to upper rail 18. Mounting means 33 is configured to be attached to upper rail 18, e.g., by a slide fitting 34 or in any other convenient fashion. Mounting means 33 may be integral to rail 18. Hinge 35 or other suitable retaining means may be attached to panel 17 to permit mounting to mounting means 33. Any suitable mounting procedure may be employed, e.g., a force fit relationship or a mounting means 33 containing apertures therein for inserting a fastening means, e.g., one or more bolts and nuts, rivets or metal screws (not shown) to hold panel 17 in position. Panel 17 is configured to be pivoted about hinge 35 to move from a position concealing and protecting the flexible hose service conduits to a position providing access to the conduits and the hose fittings.

It should be noted that the bottom portion of upper rail 18 is generally configured in a manner similar to the bottom portion of lower rail 1.

Rails 1 and 18 shown in FIG. 2 depict the use of a device plate 36 employed in the lower portion of the rail. This device plate, which is discussed in detail below, divides the lower portion of the rail into three separate channels for receiving conduits, namely channels 37, 38, and 39.

Figure 3:
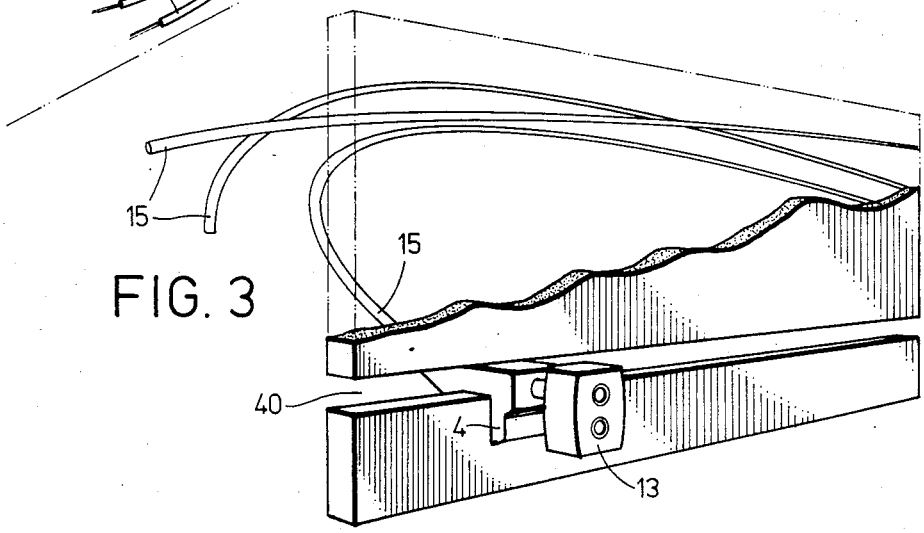
FIG. 3 is a front elevational view of a service wall outlet according to the present invention where the generally linear section of the service outlet wall is a horizontal opening in the wall positioned at a location intermediate the upper and lower ends of the wall.

FIG. 3 depicts an embodiment of the present invention wherein at least one generally linear section of the wall member of the service outlet wall comprises a horizontal opening 40 in the wall positioned at a location intermediate the upper and lower ends of the wall. In this embodiment, which shows a generally vertical wall, the service conduit housing means comprises an enclosed area adjacent the back of the vertical wall and adjacent the horizontal opening (not shown). The service outlet or outlets employed in this embodiment are configured to be mounted on the vertical wall on the top or bottom edge of the horizontal opening in the wall member. The service outlets are slideable along the edge of the horizontal opening in the wall member to permit the service outlet to be positioned along the edge. Simultaneously, the service conduit connected to each service outlet is movable to be repositioned in the enclosed area to maintain the service conduit in a concealed and protected position.

As will be readily understood, any combination of linear sections, i.e., one or more horizontal openings in said wall positioned at locations intermediate the upper and lower ends of the wall or one or more rails similarly positioned, may be employed with service conduit housing means comprising, e.g., troughs or enclosed areas as described above.

In all instances according to the present invention, the generally planar wall member, the generally linear section of the wall member, the service conduit housing means and the service outlets and conduits cooperate to make the service outlets slideable along the support sections to permit the service outlets to be positioned and supported there along, and simultaneously permit the service conduits to be repositioned in a concealed and protected condition.

Figures 4, 5:
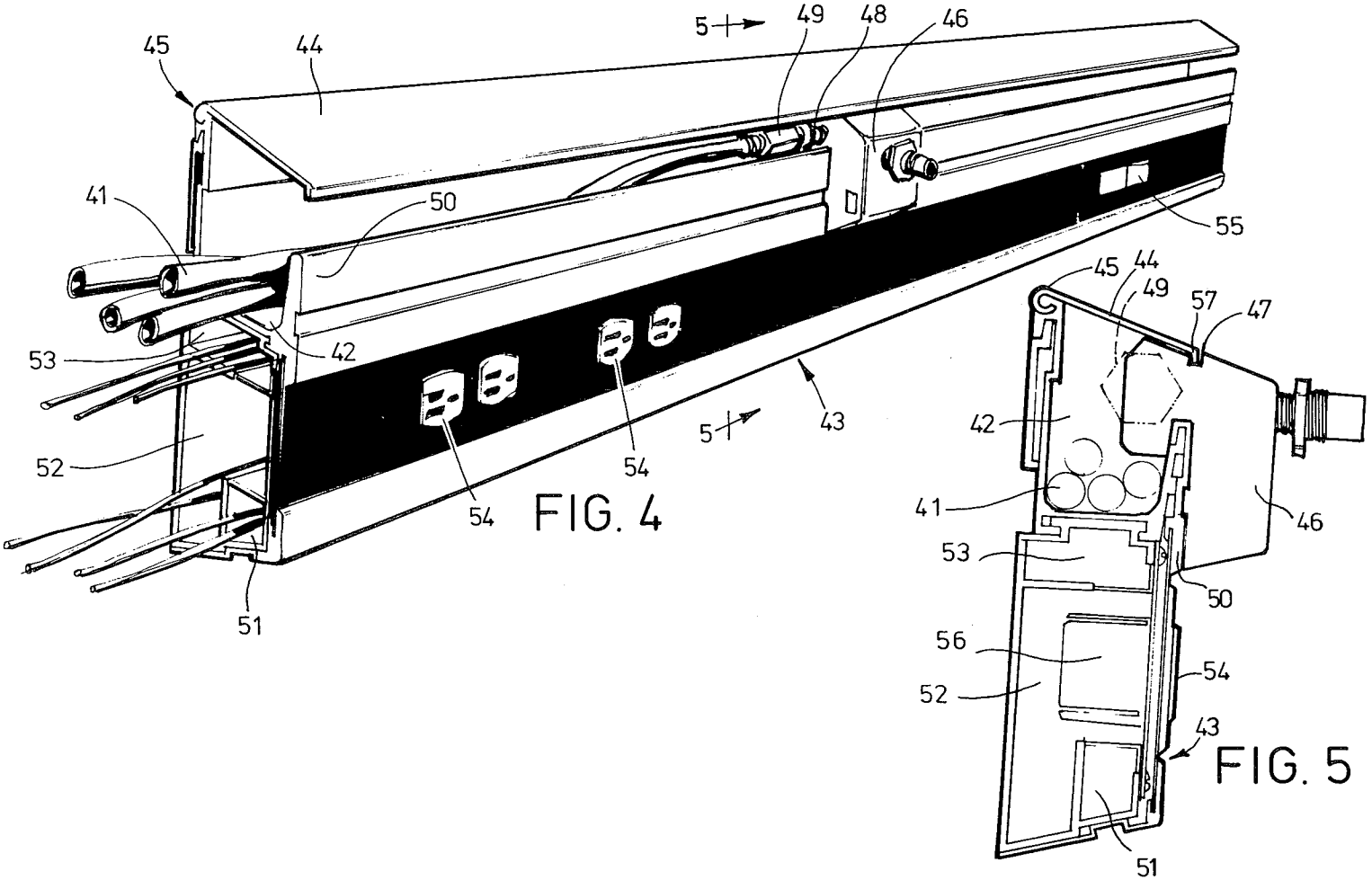
FIG. 4 is a perspective view of one embodiment of the rail system according to the present invention.
FIG. 5 is a section of a side elevational view of the rail system in FIG. 4, taken along the line 5—5.

FIG. 4 shows yet another embodiment of the service outlet wall according to the present invention. Conduits 41 are concealed in trough 42 formed in the upper portion of rail 43, and in part by panel 44. Panel 44 is movably, e.g., hingedly, attached directly to rail 43 at 45 in any convenient manner. Panel 44 pivots around the line formed at 45 and cooperates with rail block 46, either resting thereon or adjacent thereto or in a channel form therein, as shown in FIG. 4 at channel 47. Rail block 46 has a service conduit or hose fitting 48 which connects to hose fitting 49 to service conduit or hose 41. Rail block fitting 48 is shown on one side of rail block 46, but could conveniently be located on other portions of rail block 46, e.g., on the bottom portion of rail block 46 extending into trough or channel 42. Depending on the configuration of vertical edge 50 of channel 42 and the location of the hose fitting 48 on rail block 46, it is possible to configure the service outlet wall according to the present invention in such a fashion that the hose is concealed and protected in trough 42 without the need for panel 44. For the purpose of this invention, the rail block fitting employed to connect the service conduits to the rail blocks can be a fixed or movable fitting.

In the embodiment shown in FIG. 4, the bottom portion of rail 43 comprises a plurality of channels 51, 52, and 53 configured to receive service conduit directed to fixed service outlets, e.g., outlets 54 and 55.

FIG. 5 is a sectional view of the side elevation of the rail system according to FIG. 4. FIG. 5 shows junction box 56 mounted in the interior of channel 52 and associated with an outlet 54. Typically, a junction box or a device plate is provided for each fixed service outlet in this portion of the rail system.

In FIG. 5, rail block 46 is shown as having a channel 47 in the upper surface thereof. Panel 44 has a front lip or edge 57 which cooperates with channel 47 in this embodiment, lip 57 fitting into channel 47 and providing additional surface, along with the upper surface of edge 50, for guiding the rail block 46 along the horizontal path formed between lip 57 of panel 44 and the top surface of edge 50.

The service conduit employed in the present invention may be flexible or rigid. Preferably, the service conduit comprises a flexible section and a rigid section. The flexible section is typically that section connected to the service outlet, since that section of the service conduit must move with the service outlet when the service outlet is repositioned. The rigid section may comprise rigid piping, e.g., copper piping or aluminum extruded conduit block which has been drilled to provide access to interior conduits. The rigid section may terminate behind the vertical wall or may be channeled through a vertical headwall unit. The rigid piping may terminate at hose fittings on the headwall unit or may extend beyond the vertical headwall unit and into the enclosed area of the service outlet wall of the present invention.

Figures 12A, 12B:
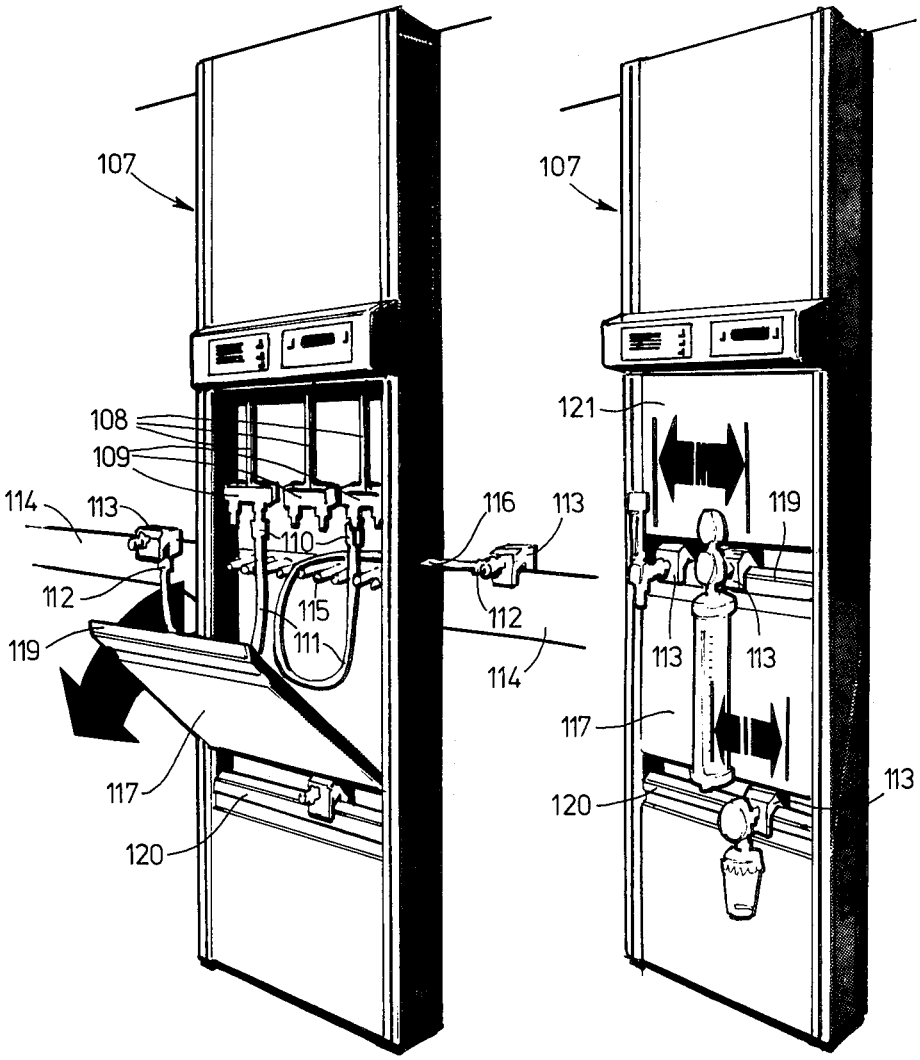
FIG. 12A depicts the service wall outlet according to the present invention wherein the horizontal rail extends into the vertical headwall unit.
FIG. 12B is a perspective view of the service outlet wall shown in FIG. 12A, with the front panel shown in the closed position.

The flexible section of service conduit may comprise a flexible hose, e.g., a reinforced PVC hose. The flexible section of the service conduit may be connected to the rigid section of the service conduit by a manifold block or junction box, as shown in FIG. 12A, detailed below. The manifold block or junction box may be located in the vertical headwall unit or in an enclosed area, and may be constructed of any suitable material.

Typically, the flexible hose is housed in the enclosed area or trough in a suitable manner, so long as it remains in a concealed and protected condition during and after repositioning of the service outlet and service conduit. Preferably, the flexible hose is suspended in a position generally parallel to the rail or opening, and is supported at a location intermediate the ends of the rail or opening in a manner such that the hose may be directed from the support location in a generally downward or upward direction to the positions on the rail or opening where the service outlets are located. The flexible hoses are of sufficient length to permit simultaneous repositioning of the hoses and the service outlets. The support located intermediate the ends of the rail or opening may be a peg or hook or other suitable support, as previously described. The support may be fixed or movable and may, e.g., be adjustably attached to the rail itself.

The service outlet wall according to the present invention is typically mounted on a room wall and is positioned in a location intermediate the upper and lower edges of the room wall. The service outlet wall may extend the full length of the room wall or only to a portion thereof. When multiple rails or openings are employed, they may be of the same length or of different lengths.

The enclosed area of the service outlet wall of the present invention may include a fixed or movable front panel means. If movable, ready access is provided to the service conduits to permit, e.g., repairs or maintenance to be conducted or to facilitate reconfiguring the service outlet wall and to provide for changing patient needs or to modify the level of care being provided in a particular room. Movement of the panel means may be accomplished by any convenient method, e.g., a hinge arrangement, a sliding arrangement or the like.

The movable front panel means may be hingedly mounted to provide access to the service conduits. The panel may be hingedly mounted to, e.g., the vertical wall, to second rail located generally parallel to and at a distance from the first rail or to some other mounting means. The second rail may also contain a generally linear support section configured to receive at least one service outlet, providing the opportunity for employing a multiple rail version of the service outlet wall of the present invention. The second rail may be located above or below the first rail.

The cover panel may also be hingedly or movably attached to the rail itself, as shown, e.g., in FIGS. 4 and 5 discussed above. The panel may be attached to the rail at any convenient location, for example, on the upper edge or along the back of the rail.

The panel may also be attached to a support connected in some fashion to a vertical wall or to the second rail. The latter embodiment is shown, e.g., in FIGS. 1 and 2 of above.

The panel may be secured in the closed or open position.

The front panel means may be configured to move to any desired position. Preferably, the front panel means is configured to be hingedly moved from a generally vertical position, where the panel means conceals and protects the service conduit, to a generally horizontal position, where the panel means provides the access to the vertical wall, the service conduits and the connecting points on the service outlets.

The rail employed in the present invention may comprise a unitary structure or a plurality of unitary structures in interlocking relation. Preferably, the rail may comprise at least one unitary metal extrusion, constructed, e.g., of aluminum, and at least one unitary plastic extrusion, constructed, e.g., of polyvinyl chloride, the extrusion in interlocking relation. A typical configuration is described above in connection with FIGS. 1 and 2.

The service outlets employed in the service outlet wall of the present invention may be constructed of any suitable material, e.g., plastic or metal. Typically, the service outlets will contain fittings for receiving a service conduit and for providing services to the patient care area. The service outlets may be configured to be positioned on the rails and to extend generally below the rails, generally above the rails, or may be in any other desired configuration.

The services provided by the service conduits to the service outlets may be any service required for providing patient care. The services provided to the patient care area may comprise gas services, e.g., oxygen, nitrogen, aseptic air, vacuum or suction; liquid services, e.g., intravenous solutions or dialysis fluids or service water (e.g., an in-room service sink unit), electrical services or services providing solids to the patient care area.

The service outlets are configured to receive the particular services forwarded by the service conduits.

The electrical services provided by the service conduits employed in the service outlet wall of the present invention typical comprise electric service lines or wires for providing power to electrical service outlets or electrical service devices. The electrical service conduits employed in the present invention may provide sources of various levels of the electrical power, e.g., high voltage power, low voltage power, or standard voltage power. A plurality of electric service lines may simultaneously be employed to provide various levels of electrical power to the patient care area.

Figure 18:
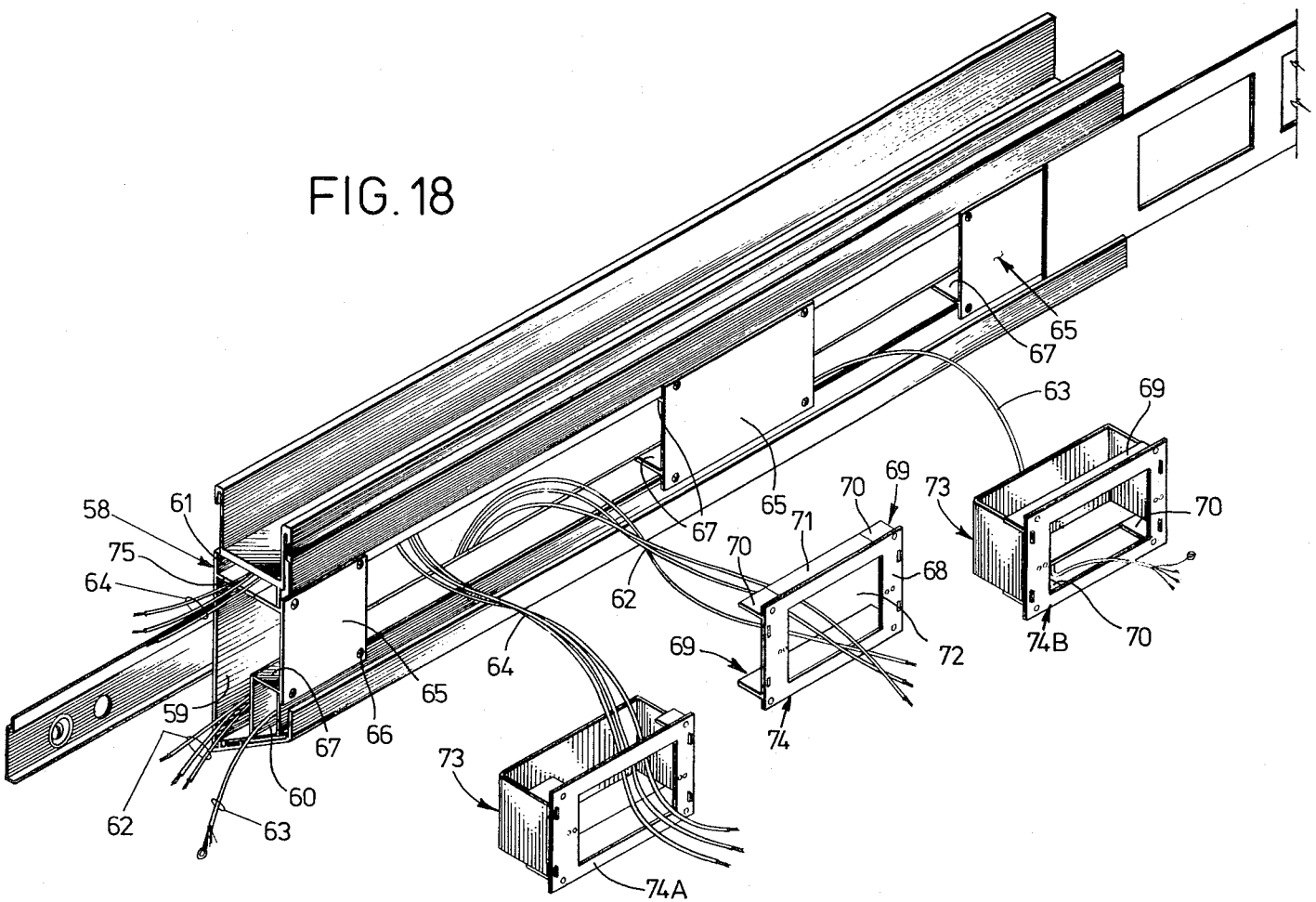
FIG. 18 is a perspective view of the preferred fixed electric service outlet configuration which may be employed in the present invention.

The preferred configuration for providing multiple electric power services to fixed outlets in one portion of the rail is shown in detail in FIG. 18. The main body or basic frame 58 of that portion of the rail retaining the fixed service outlets is, e.g., an aluminum extrusion that comprises channels 59, 60 and 61 for providing three sets of electrical service lines to provide three different voltage levels to the fixed outlets. Channel 59 houses electrical service conduit 62 for providing standard power to the service outlet wall fixed outlet. Channel 60 houses electrical service conduit 63 for providing low voltage power and channel 61 houses conduits 64 for providing emergency or high voltage power.

In conjunction with the basic frame, a second series of members is required to provide three separate channels or raceways for providing electrical power to the fixed outlet in a manner which permits complete separation of the various levels of power. Members 65 comprise channel or raceway cover members. A plurality of these cover members is provided and, as will be seen, junction boxes or device plates are placed intermediate cover members 65 for housing electrical service outlets. Cover members 65 may be attached to the main body or basic frame 58 in any convenient fashion, e.g., by employing sheet metal screws 66, a plurality of which are shown in FIG. 18. The raceway for forming channel cover member may be constructed of any convenient material, and is preferably also an aluminum extrusion.

The third component of the preferred fixed electrical outlet system is a device plate member. This device plate member is configured to fit in the openings formed by the juncture of main body 58 and cover members 65. A device place is typically constructed of a plurality of wall members, one such wall member 68 being parallel to the face member of cover members 65. Two wall members 69 are located perpendicular to face member 68 and positioned to be parallel to perpendicular members 67 of cover members 65 when the device plate is in place. One of the walls 69 is constructed with two ear members 70 and a center removable portion 71. Wall members 68 has an opening therein, preferably in the form of a rectangular opening 72.

In order to provide the three levels of power discussed above, the device plate is used either alone or in conjunction with a junction box 73. Junction box 73 is typically a rectangular shaped box with a back wall, two sidewalls and a floor. The floor corporates with perpendicular wall 69 of device plate 74 to form a solid bottom wall or to form the opening for one type of electrical service conduit. In FIG. 18, three device plates 74, 74A and 74B are shown in three different configurations. Device plate 74 is shown in the configuration employed to receive standard power conduits 62. The device plate is used without a junction box and is inserted into an opening between cover members 65. Standard power lines 62 are run through channel 59 and into the opening 72 of device plate 74. A desired electrical service outlet is mounted in the device plate.

Device plate 74A is shown in a configuration to provide emergency or high voltage power through lines 64. The wall 69 separates the standard power line and outlet from the emergency and low voltage channels and line. The central portion 71 of one wall 69 has been removed and emergency power lines 64 are channeled through raceway 61 to the opening formed by the removal of section 71. A junction box 73 is employed and corporates with ears on the top portion thereof. Solid bottom wall 69 corporates with the floor portion of junction box 73 to form a solid bottom floor, separating the emergency power channel and outlet from the standard and low voltage channels.

Device plate 74B is shown in yet another configuration to provide low voltage power to a service outlet. In this configuration, the device plate is turned 180 degrees, with the perpendicular wall 69 having the center section 71 removed on the bottom of the device plate. The device plate is again used in conjunction with a junction box 73. In this fashion, the solid wall is formed in the upper part of the junction box/device place combination by perpendicular wall 69 of the device plate and wall 75 of main body or basic frame 58. The floor of the junction box 73 and the ears 70 of device plate 74B cooperate to form an opening for receiving the low voltage service conduit. The configuration of the junction box/device plate isolates the low power conduit and outlet from the emergency and standard power conduits.

While the largest raceway or channel shown in FIG. 18 has been designated for standard power, it should be understood that any arrangement of the various power levels could be employed to suit the patient care needs.

Figure 6:
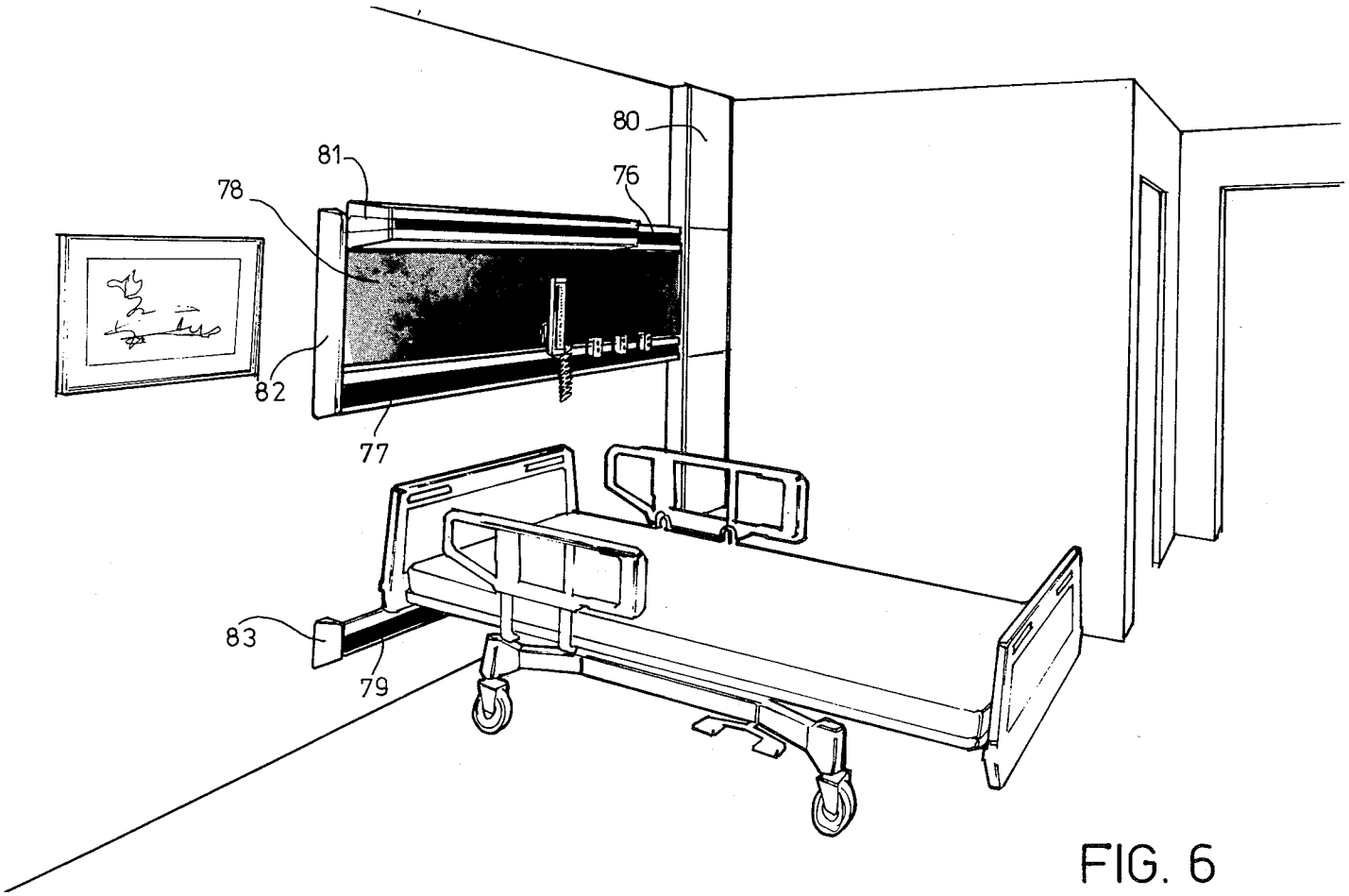
FIG. 6 is a perspective view of a patient care room employing one embodiment of the present invention.

FIGS. 6 through 9 depict the flexibility of the service outlet wall of the present invention in facilitating the reconfiguration of patient rooms to provide different levels of patient care. In FIG. 6, a three-rail system as shown, the upper two rails 76 and 77 having panel member 78 intermediate thereto. Lower rail 79 is separately mounted. All rail members are serviced by vertical headwall unit 80. The configuration shown in FIG. 6 is a relatively basic configuration for use in a private patient room. Upper rail 76 holds safety light fixture 81 and middle rail 77 holds a number of service outlets and devices. Lower rail 79 may be used for a variety of services, and provides fixed electrical services to the bed. End panels 82 and 83 are provided for decorative effect and to close off the ends of rails 76, 77, and 79.

Figure 7:
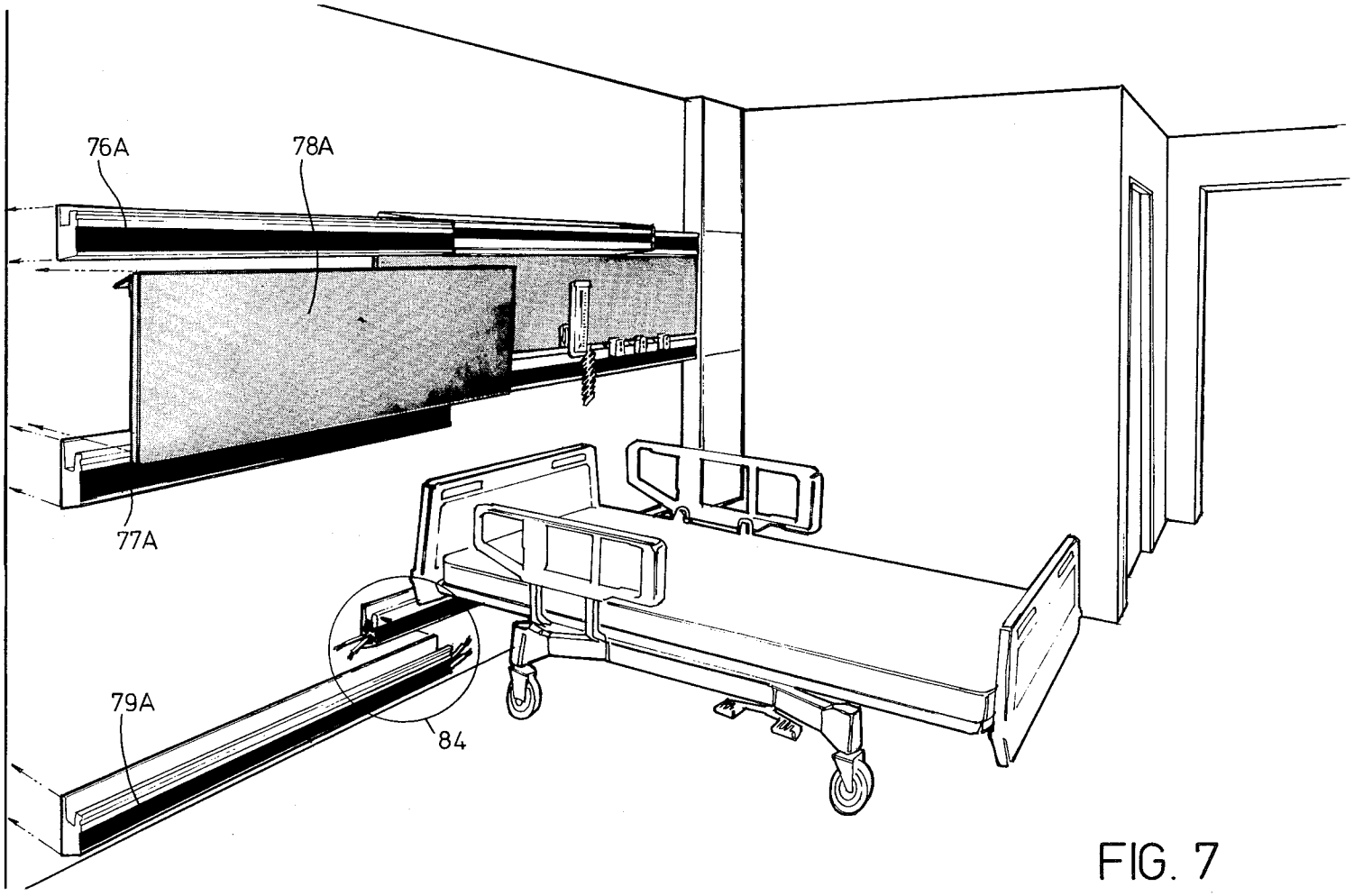
FIG. 7 is a perspective view of a patient care room employing another embodiment of the present invention, wherein the service outlet wall is added to an extended portion of the room wall.

FIG. 7 depicts modification of the patient room shown in FIG. 6 to add an additional section of the service outlet wall of the present invention. Rails 76A, 77A and 79A are provided with in-field wiring installed as depicted at 84. Additional panel 78A is located between rails 76A and 77A. Cover members 82 and 83 are removed to permit extension of services into the new section of the service outlet wall.

Figure 8:
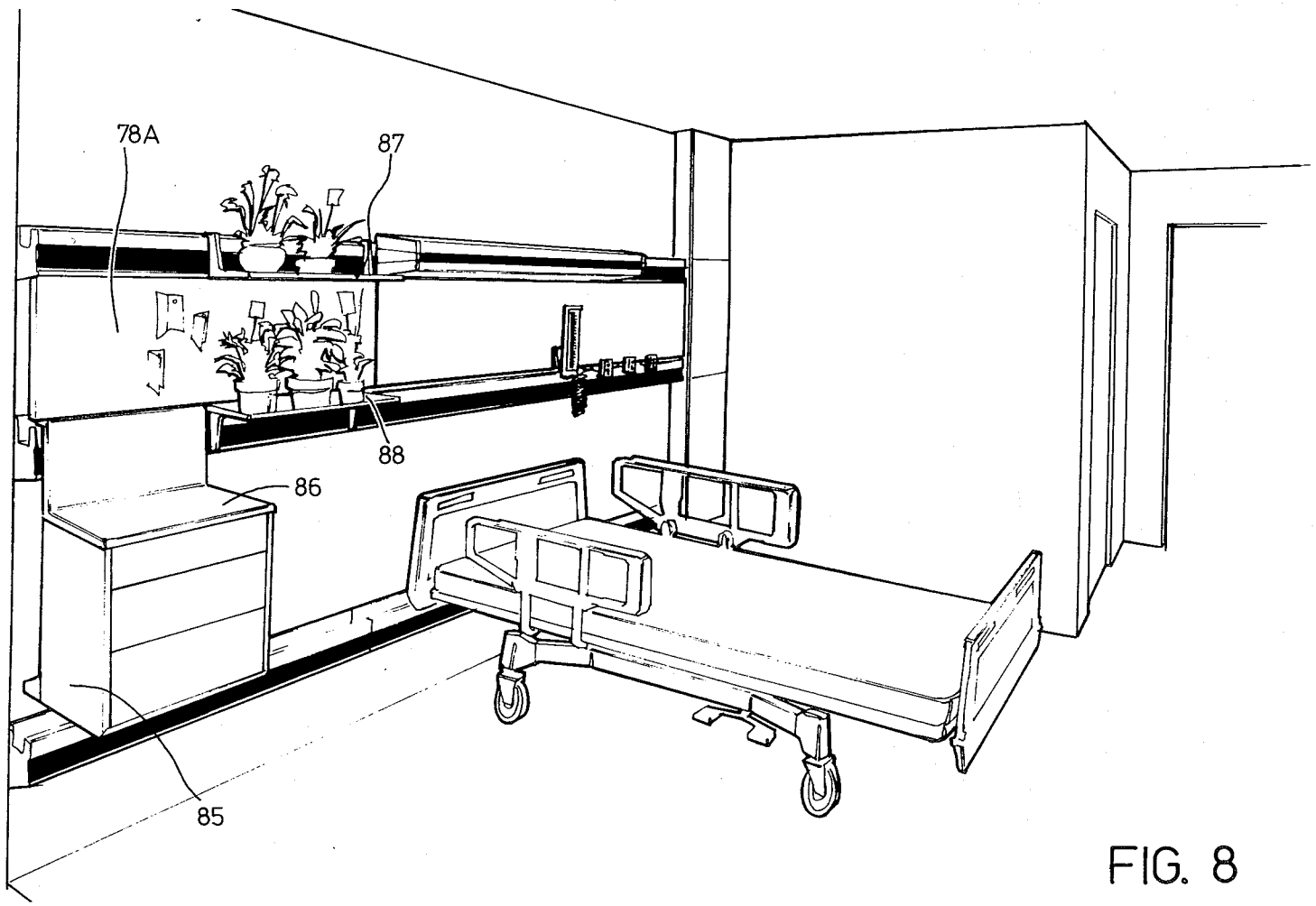
FIG. 8 is a perspective view of a patient care room showing the extended portion of the service outlet wall employed in a patient room environment.

FIG. 8 shows the completed modification described in connection with FIG. 7. Additional services provided to the patient room area include rail hung cabinet 85 with work surface 86 and rail hung shelves or work surfaces 87 and 88. As will be seen, panel member 70A is constructed of a material which permits the panel member to also function as a message board or tack board for displaying cards, notes and the like.

Figure 9:
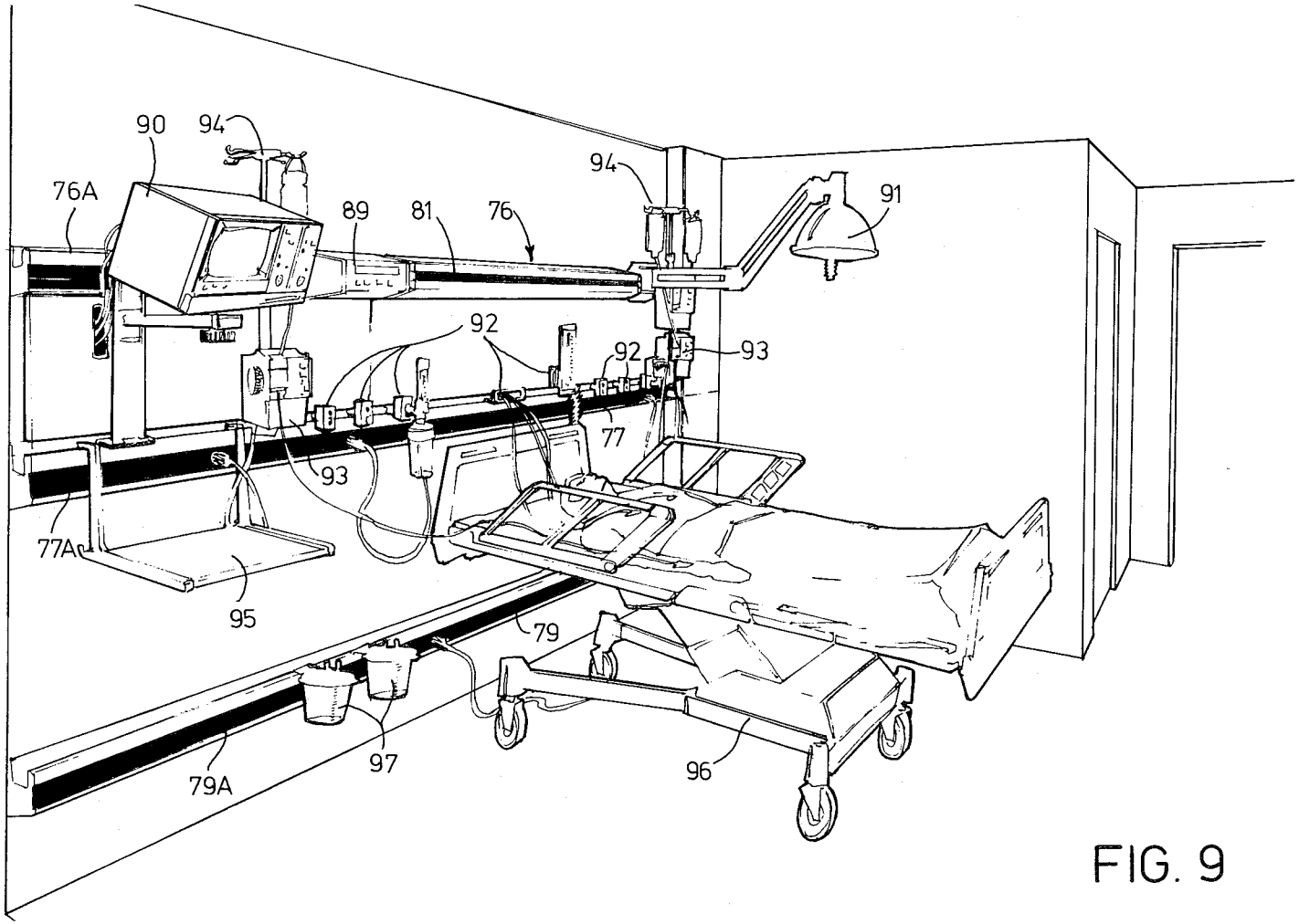
FIG. 9 is a perspective view of a patient room showing the service outlet wall of the present invention employed in a patient room environment requiring a different level of patient care.

FIG. 9 shows the service outlet wall of FIG. 8 reconfigured to provide a level of care required, e.g., in an intensive care unit. Upper rail 76A holds a variety of electric service devices such as safety light fixture 81, timer 89, monitor 90 and examination light 91. Middle rail 77, 77A holds a variety of medical gas service outlets 92 having a variety of configurations, infusion pumps 93, I.V. supports 94 and work surface 95. Fixed electrical outlets are also provided to the middle rail. Lower rail 79, 79A has a number of fixed electrical outlets, one of which is shown providing power to the hospital bed 96. Vacuum devices 97 are also mounted for use on lower rail 79, 79A.

As previously discussed, a variety of service outlets, including service devices, may be employed in connection with the service outlet wall of the present invention. Service outlets and devices which have shapes or sizes which exceed the cavity spaces within the rail are loaded into separate housings or supported in some fashion exterior of the rail, and typically the housing or support is hung on the rail. This allows the rail to retain its generally narrow standard profile without modification for such devices. While not intending to encompass all possible service outlets and/or service devices, the following outlets are typical of those which may be employed in connection with the present invention: safety light fixtures for providing patient/nursing lighting; nurse call devices and other patient room communication devices; I.V. bottle hangers or supports; elapsed time clocks or other timing devices; monitors for checking electrical integrity of service conduits and outlets; monitor support brackets; equipment shelving to support, e.g., defibrilators and other patient room equipment; storage modules for patient/nursing storage; examination lighting; overbed lighting for patient/nurse lighting purposes; supports for computer equipment and data input devices, video displays; keyboards; optical scanners; charting shelves to provide nursing work surfaces, blood pressure devices to measure blood pressure; charting trays to hold nurse chart boards; instruments; instrument support brackets; infusion pump systems, infusion pump support systems; ventilators and ventilator shelves; oxygen blenders and brackets therefore; utility hooks; post mounts for holding a variety of devices; vertical track mounts for secondary equipment attached to one or more parallel rails and adjustable anywhere along the one or more rails; telephones and telephone mounts; utility baskets; bed pans and bed pan racks; bed bumpers; drainage bottles and holders; waste receptacles; bed power modules; bed locator devices; and hospital beds. As will be noted, the above-listed devices include passive devices as well as those connected and linked in some fashion to concealed and protected service conduits. Service devices may be movable along the rails by hand or may be power-assisted in any suitable fashion.

It is intended that the service outlet wall of the present invention will provide support for outlets and devices connected to such service conduits as well as those which are not so connected.

Figure 10A:
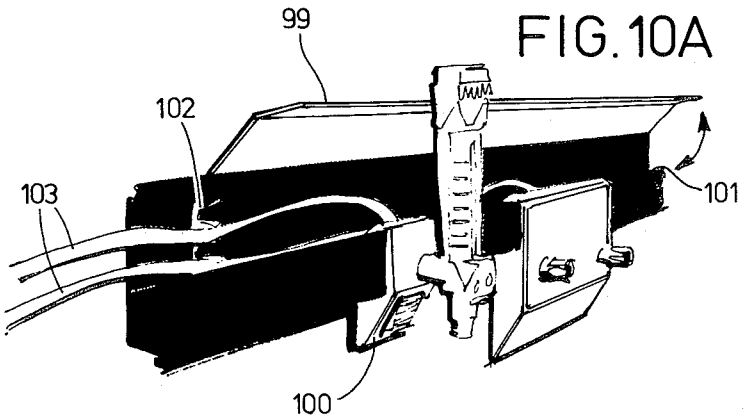
FIG. 10A is an enlarged view of a portion of the service outlet wall of FIG. 10, showing the panel in the open position.
Figure 10B:
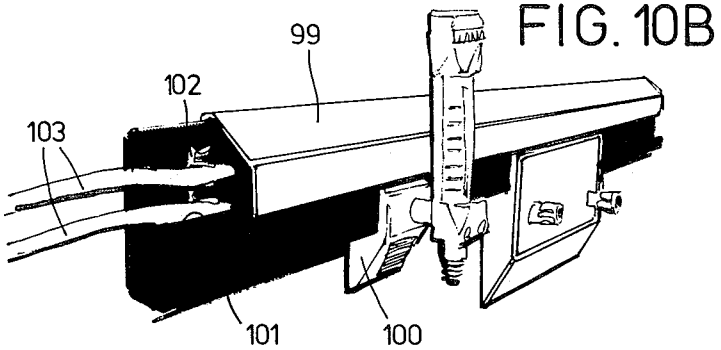
FIG. 10B is an enlarged portion of the service outlet wall of FIG. 10, showing the panel in the closed position.
Figure 10:
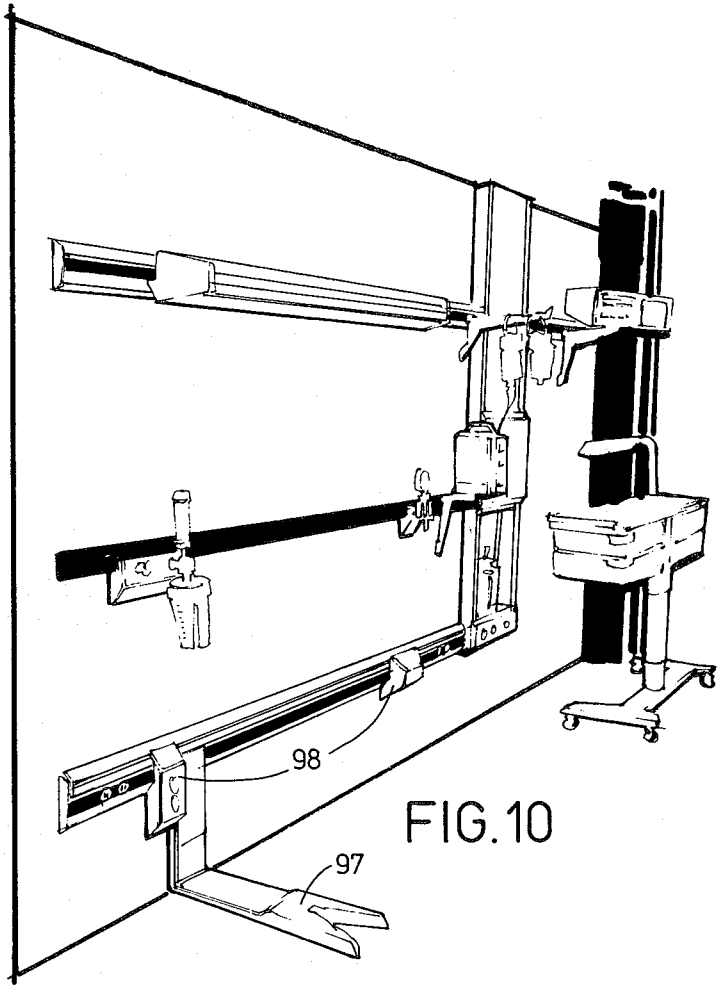
FIG. 10 is a perspective view of a service outlet wall according to the present invention wherein the front cover is pivotedly mounted with respect to the rail and wherein a vertical headwall is employed in conjunction with the service outlet wall.

FIG. 10 shows yet another embodiment of the present invention comprising a plurality of horizontal rails connnected to a vertical headwall unit. The bottom rail supports a bed locator device 97 and bed bumpers 98. The upper rail in FIG. 10 extends on both sides of the vertical headwall. Any combination of horizontal rails and vertical headwall units may be employed in the present invention. FIG. 10A shows cover panel 99 in the open position with gas outlet or rail block 100 mounted on the upper surface of rail 101. Support bracket 102 is provided to hold service conduit 103 in place and to permit movement of rail block 100 and surface conduit 103 to various positions along the top surface of rail 101.

FIG. 10B shows cover panel 99 in the closed position. In use, cover panel 99 would extend the full length of rail 101 and completely conceal and protect conduit 103.

Figure 11A:
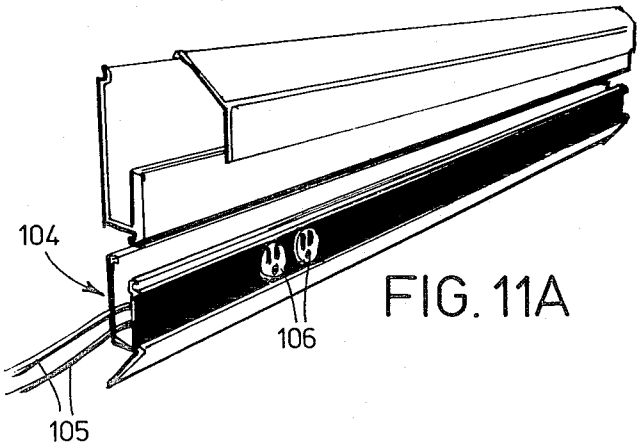
FIG. 11A is a perspective view of another embodiment of the service outlet wall according to the present invention, wherein the front panel is hingedly attached with respect to the rail and wherein a portion of the rail is configured to receive electric services.
Figure 11B:
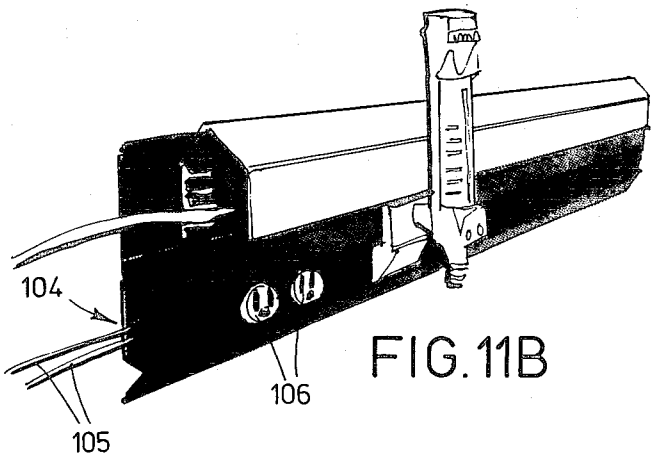
FIG. 11B is a perspective view of the service outlet wall of FIG. 11A, showing the front panel in the closed position and the upper and lower rail sections in interlocking relation.

FIGS. 11A and 11B depict an embodiment of the present invention employing the horizontal rail and cover panel described in connection with FIGS. 10A and 1OB above, along with a second section 104 to provide service conduits to fixed outlets. In FIGS. 11A and 11B, service conduits 105 are housed in interior of section 104 and channeled to service outlets 106. FIG. 11A shows section 104 of the rail separated from the main section of the rail and FIG. 11B shows the rail interlocked to form a unitary piece. FIG. 11B also shows a service device mounted to a service outlet and movable along the rail.

The various service outlets which may be employed in connection with the service outlet wall of the present invention may be supported on the service outlet wall in a variety of manners. For example, device supports, i.e., brackets, shelves and the like may be hooked onto the rail with the particular service device being placed on or attached to the bracket or shelf. It is also possible that the support means or the service device is integral to the service device. In this manner, the support means portion of the integral service device is hooked directly to the rail. It is also possible that a rail block can be employed to support a service device which is attached to a rail block fitting.

The service outlet wall according the present invention contemplates employing a single rail or multiple rails. Typically, the multiple rails are mounted in parallel on a vertical wall at some point intermediate the upper and lower edges of the wall. A gap is typically left between rails. The enclosed area of the present invention may be formed by placing a front cover panel over a gap between two rails. The front cover panel may be movable mounted to provide access to the service conduit positioned between the rails. For example, the front panel may be hingedly mounted as described above.

As also previously mentioned, the present invention may be employed in connection with a vertical headwall unit. Such a headwall unit is described in U.S. Pat. No. 4,338,485, assigned to the same assignee as the present invention, which disclosure is herein incorporated by reference and made a part hereof. One or more rails may be employed on either side of such a vertical headwall and a plurality of vertical headwalls may be employed in connection with a particular service outlet wall configuration.

Each of the rails employed in a multiple-rail version of the present invention may function in the same manner as that described above to protect and conceal service conduit.

FIG. 12A shows yet another embodiment of the present invention wherein the service outlet wall of the present invention is embodied in whole or in part in a vertical headwall unit. Vertical headwall unit 107 shows rigid medical gas line conduits 108 being fed from the wall or ceiling to manifolds 109. Hose fittings 110 connect flexible hoses 111 to manifolds 109. Flexible hoses 111 are in turn connected by hose fittings 112 to rail blocks or service outlets 113. These rail blocks or service outlets 113 may be mounted to horizontal rails 114 which are part of the present service outlet wall invention as described above but not shown in detail in FIG. 12A. Flexible hoses 111 are directed over dowels 115 and out of the vertical chase onto the horizontal rail at opening 116. While flexible hoses 111 are depicted in an exposed fashion in FIG. 12A, this is done only to show the various connections described above. Typically, these hoses would be concealed in an enclosed area or trough in accordance with the present invention. Front panel 117 forms the enclosed area within the vertical headwall where the flexible portions 111 of the service conduit are maintained in a concealed and protected condition. A separate panel not shown may be placed above panel 117 to enclose, conceal and protect the rigid piping 108 and manifold 109. Panel 117 may be movable, as shown in FIG. 12A, e.g., pivotable about its bottom edge. The upper edge of panel 117 may be configured as shown at 119 to form a rail which is part of the service outlet wall of the present invention and upon which rail blocks 113 may ride. Simply by disconnecting rail block 113 from flexible hose 111 at fitting 112, rail block 113 may be reconfigured to ride on that portion of the service outlet wall of the present invention encompassed in the vertical headwall area, i.e., to ride on rail 119 of panel member 117 or to ride on rail 120 positioned below panel number 117.

FIG. 12B shows another embodiment of the present invention wherein the service outlet wall is fully incorporated into the vertical headwall unit. This unit is substantially as described above in connection with FIG. 12A except the horizontal rails 114 are not present. Rail blocks 113 are movable along rails 119 and 120 and may be attached to any required service, as shown in FIG. 12B. In FIG. 12B, panel member 121 is shown in position over the rigid piping and manifold blocks.

Figure 13:
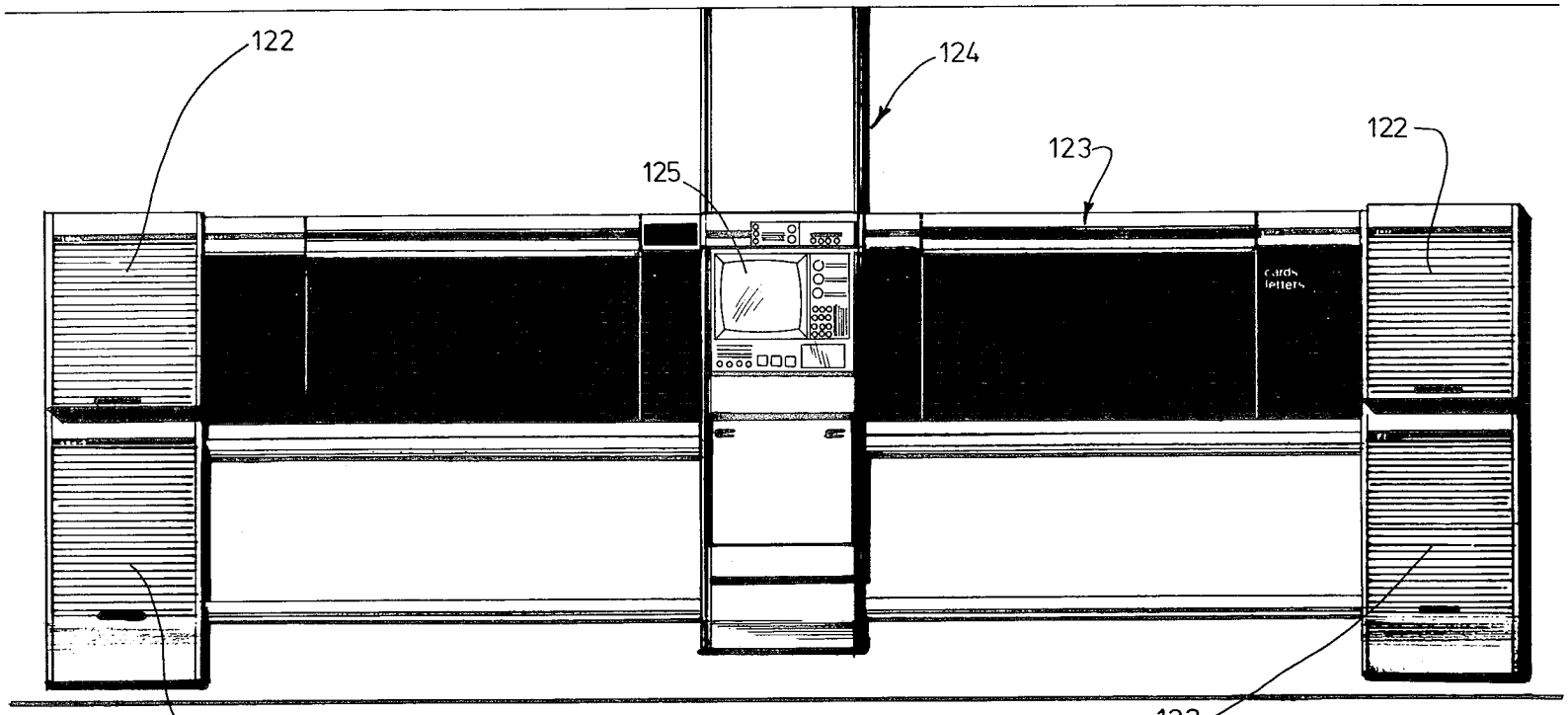
FIG. 13 is a front elevational view of the service outlet wall of the present invention showing multiple rails employed on either side of a vertical headwall unit, the vertical headwall unit containing a video display, with rail-hung storage units mounted on the ends of the service outlet wall.

FIG. 13 shows an embodiment of the present invention employing rail mounted or rail hung storage units on each end of the service outlet wall. Four such storage units 122 are shown hung on either end of service outlet wall 123. Also in this embodiment, vertical headwall 124 comprises video display 125. Typically, transfer of functions previously handled at the vertical headwall unit, i.e., conversion of fixed vertical headwall unit service outlets to movable horizontal rail service outlets, frees up the area in the vertical headwall for now and additional equipment required to implement new techniques in patient care and to house new or varied patient care products.

Figure 14A:
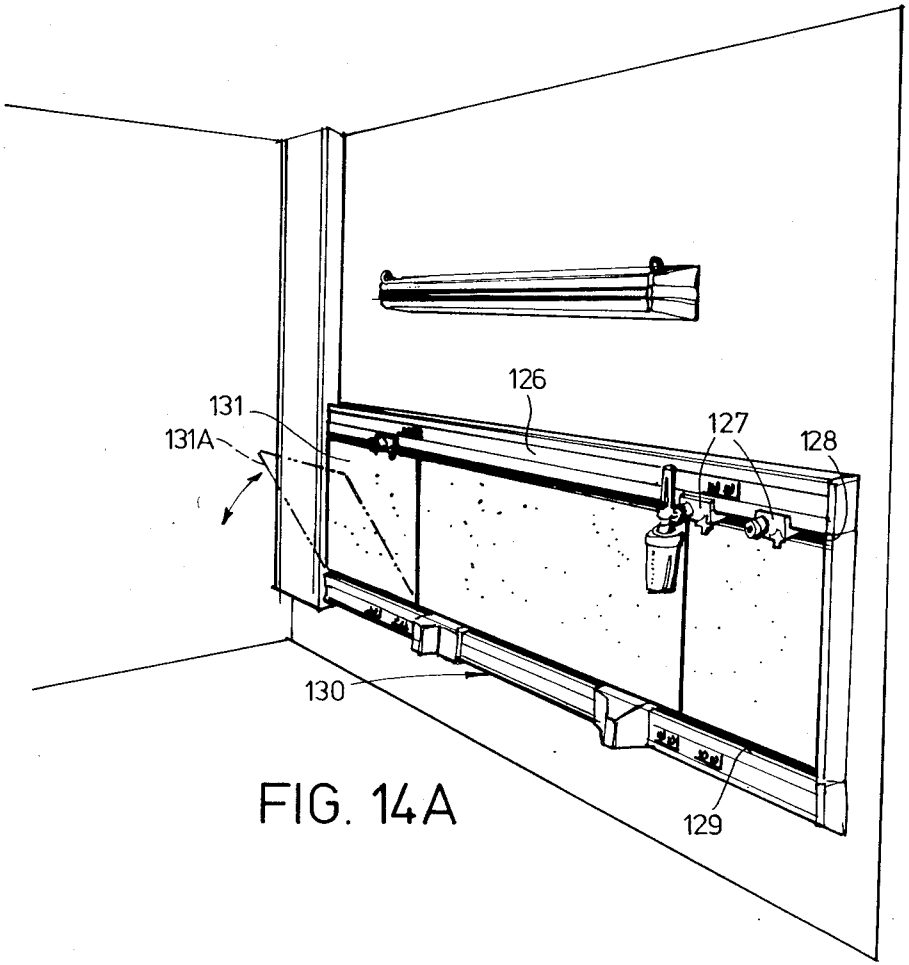
FIG. 14A is a perspective view of another embodiment of the service outlet wall of the present invention, showing a two-rail configuration where the bottom edge of the top rail and the top edge of the bottom rail are profiled to receive service outlets.

FIG. 14A shows another embodiment of the service outlet wall of the present invention employing a two-rail configuration where the bottom edge of the top rail and the top edge of the bottom rail are profiled to receive service outlets. It will be understood that either edge of any rail employed in the present invention may be configured to receive service outlets. Thus, in FIG. 14A, rail 126 is configured to receive service outlets 127 along its bottom edge 128. Service outlets may also be affixed to edge 129 of lower rail 130. Panels 131 are movable from a vertical position in which service conduit connected to the service outlets is maintained in a concealed and protected condition to a generally horizontal position wherein the service conduit is exposed for maintenance, repair or reconfiguration. Front panel 131 is shown in the vertical position and in dotted lines at 131A in a position pivoted away from the upper rail 126.

Figure 14B:
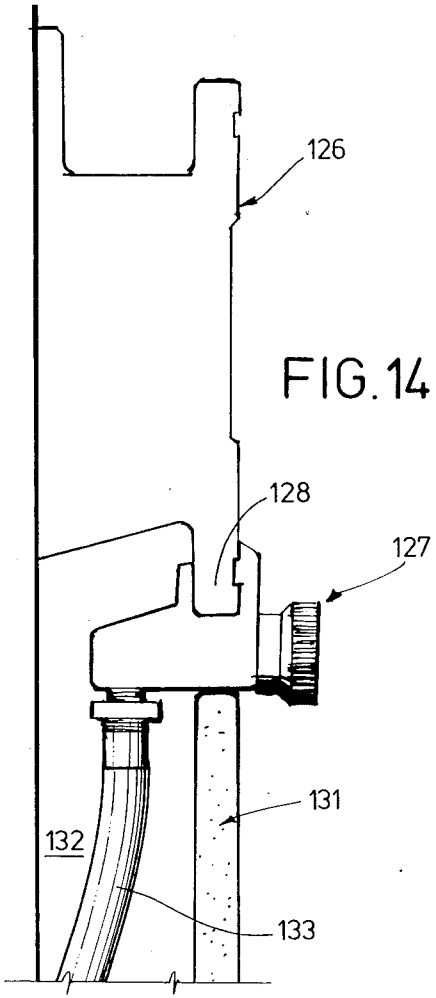
FIG. 14B is an enlarged side elevational view of a portion of the service outlet wall shown in FIG. 14A, showing a service outlet suspended on the bottom edge of the upper rail.

FIG. 14B is an enlarged side elevational view of a portion of the service outlet wall. As discussed above in connection with FIG. 14A, service outlet 127 is shown suspended on the bottom edge 128 of top rail 126. The bottom edge 128 is configured to receive service outlet 127 and to permit service outlet 127 to slide along edge 128. Front panel 131 is shown in the closed, vertical position wherein it forms a portion of the enclosed area 132 for housing service conduit 133.

Figure 15A:
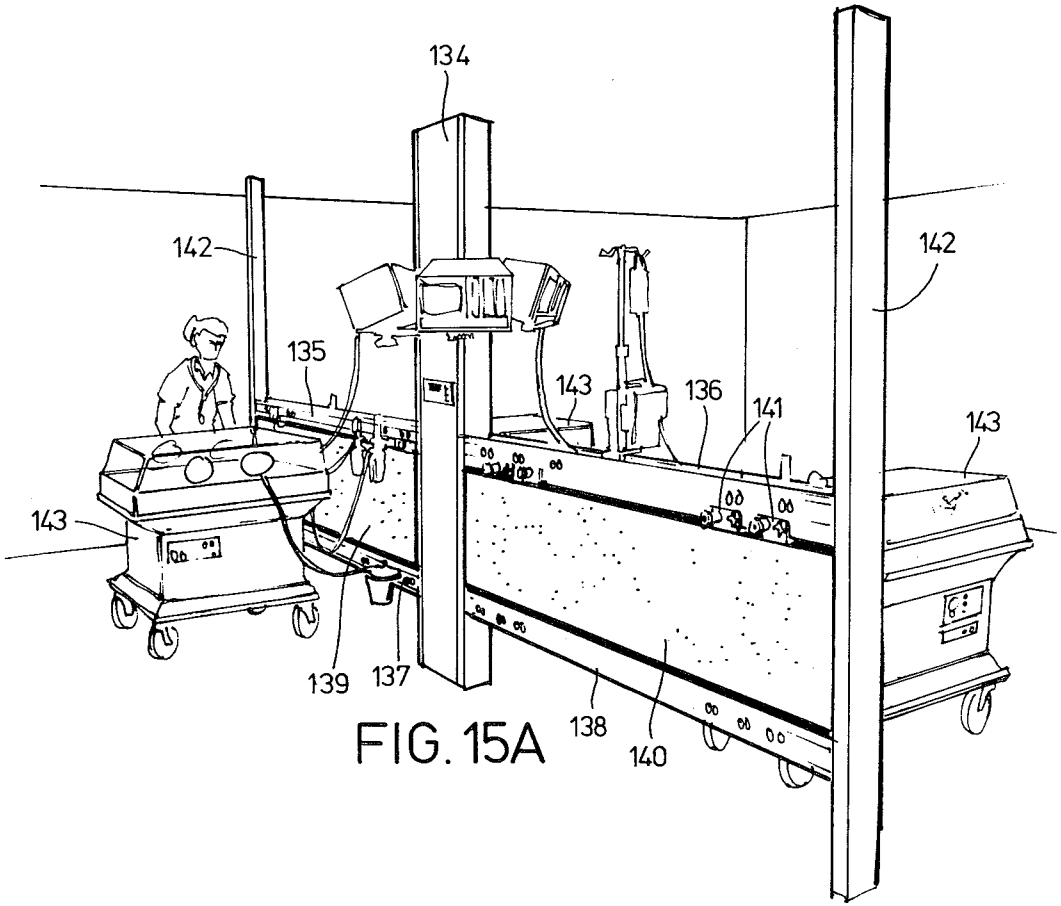
FIG. 15A is a perspective view of yet another embodiment of the service outlet wall of the present invention, showing a free standing, neo-natal unit.

FIG. 15A shows another embodiment of the present invention wherein the service outlet wall is configured to form a neo-natal unit. Vertical headwall unit 134 is placed intermediate a pair of upper rails 135 and 136 and a pair of lower rails 137 and 138. Panels 139 and 140 conceal and protect service conduits which connect to service outlets 141. Similar service outlets can be employed on lower rails 137, 138. A neo-natal unit such as the one shown in FIG. 15A may include one or more vertical headwall units 134 or may be constructed completely of horizontal rails and associated panels. Support columns 142 may also be employed. As will be seen from FIG. 15A, a plurality of neo-natal units 143 may be arranged in any desirable fashion around the service outlet wall. The service outlet wall of the present invention embodied in rails 135, 136, 137 and 138 and panels 139 and 140 may be duplicated on the back side of the neo-natal unit (not shown) to provide for the servicing of additional units where the neo-natal service outlet wall is positioned as a penninsula or an island.

Figure 15B:
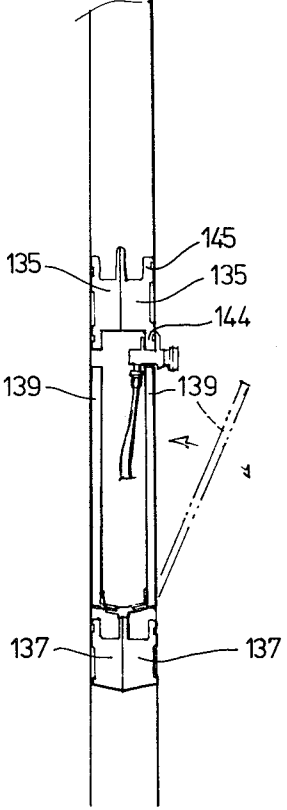
FIG. 15B is an enlarged side elevational view of one portion of the unit shown in FIG. 15A.

FIG. 15B is an enlarged side elevational view of one portion of the neo-natal unit shown in FIG. 15A. In this Figure, upper rail 135 is depicted as configured to receive service outlets on both its upper and lower edges 144 and 145. Duplication of rail and movable panels is shown in FIG. 15B, where the enclosed area concealing and protecting the service conduit is now formed by upper rails 135, lower rails 137 and panels 139.

Figure 16A:
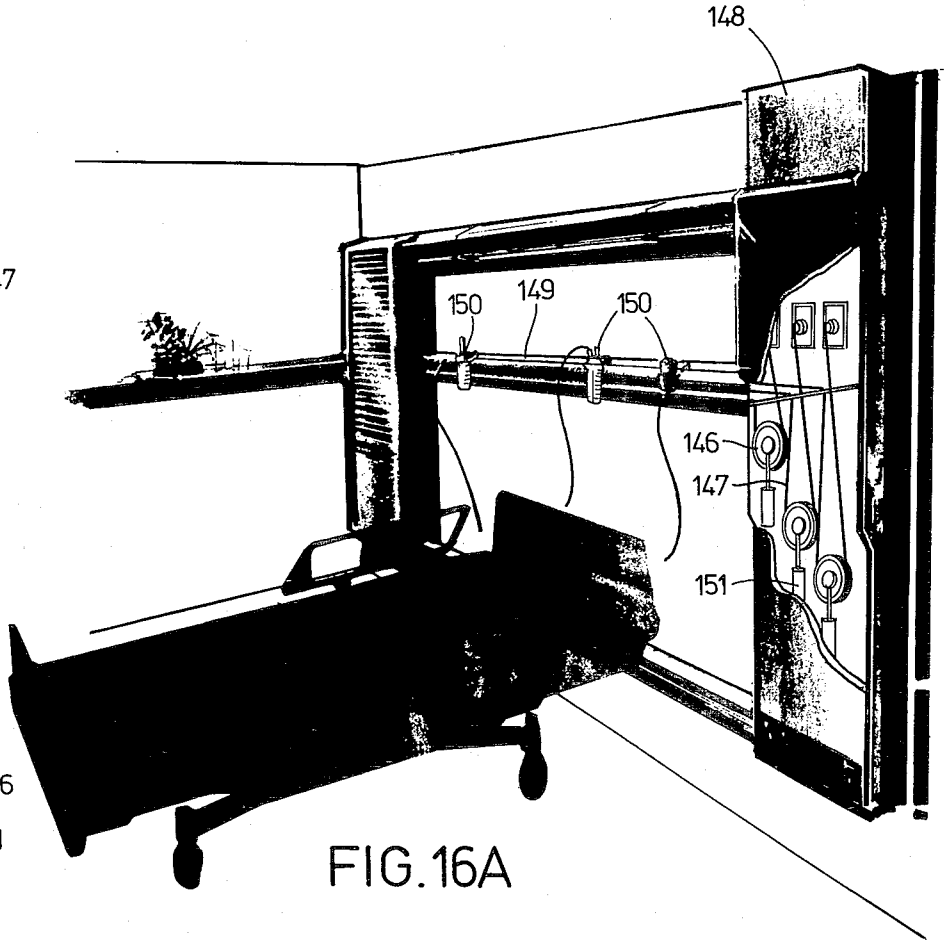
FIG. 16A is a perspective view of the patient-care room employing another embodiment of the service outlet wall of the present invention wherein service conduit retracting means are employed, e.g., in the form of movable pulleys.

FIG. 16A depicts yet another embodiment of the present invention wherein service conduit retracting means are provided which cooperate with at least one service conduit to permit the conduit and the service outlet connected to the conduit to be simultaneously repositioned in at least one trough in and along the configured edge of the rail of the service outlet wall of the present invention. In FIG. 16A, the service conduit retracting means comprises with at least one movable pulley 146. Other retracting means, e.g., spring mechanisms, hydraulic cylinders, motor driven mechanisms, and the like, may be employed as retracting means. Service conduit 147 eminates from the ceiling or wall through vertical headwall unit 148, around movable pulley 146 and subsequently out of vertical headwall unit 148 to rail 149. The service conduit is maintained in a trough located in rail 149.

Figure 16B:
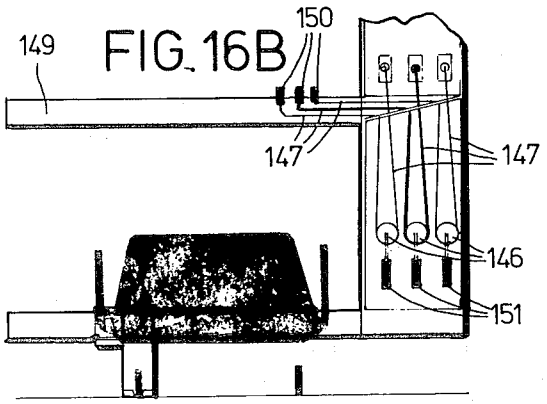
FIG. 16B is a front elevation schematic view of a service outlet wall shown in FIG. 16A, showing the service outlets located in particular locations.
Figure 16C:
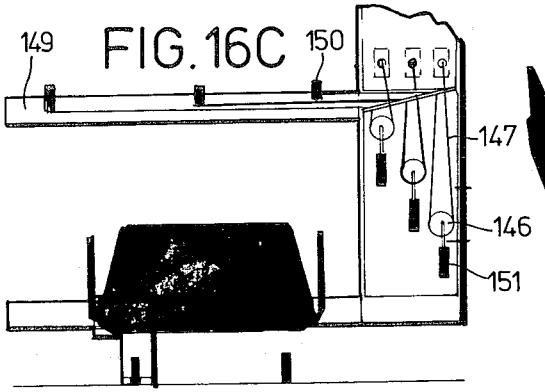
FIG. 16C is a front elevational schematic view of the service outlet wall shown in FIG. 16A showing the service outlets and conduit repositioned to different locations.

FIG. 16B is a front elevational schematic view of the service outlet wall shown in FIG. 16A. Movable pulleys 146 are configured to receive service conduits 147 and to permit the service conduits to be retracted and extended with respect to horizontal rail 149. Service outlets 150 are connected to service conduits 147 and are movable along an edge of horizontal rail 148. FIG. 16B shows the service outlets located in particular locations and FIG. 16C shows the service outlets in a repositioned configuration after horizontal adjustment. Counter balance weights 151 are employed in this embodiment to maintain an appropriate tension on pulleys 146.

Figure 17:
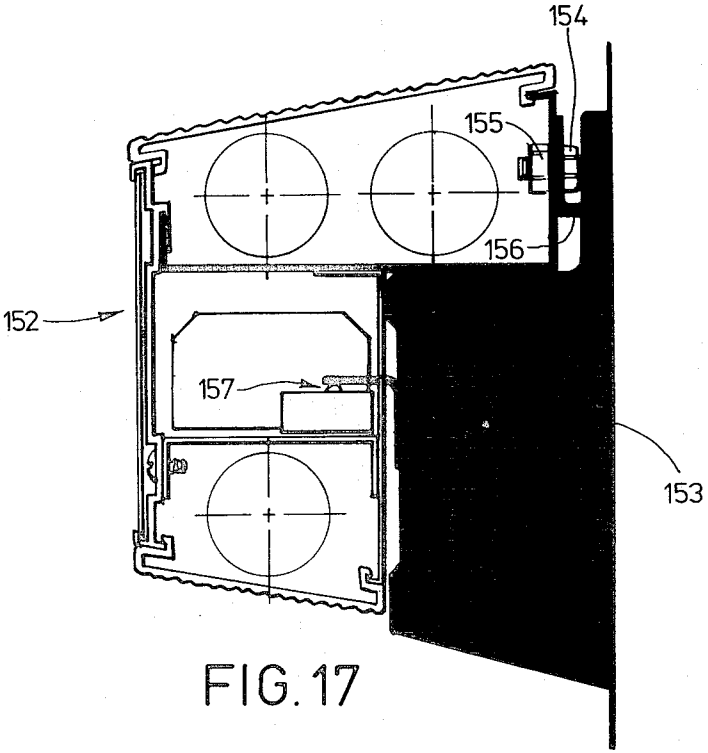
FIG. 17 is a side elevational sectional view of one embodiment of a safety light designed to be used in connection with the service outlet wall of the present invention.

FIG. 17 depicts a safety light fixture designed to be used in connection with the service outlet wall of the present invention. The safety light assembly 152 is configured to be mounted on rail 153 in any suitable fashion, e.g., by bolt 154 and nut 155 on the configured section 156 of rail 153. Alternatively, an integral mounting means may be incorporated into safety light fixture 152 and the safety light may be hung on the rail. A safety switch in the light may be employed to permit triggering of the safety feature of the light. For example, a rail-integrated switch 157 may be employed to permit triggering of the safety feature of the light fixture. The safety light operates on the general principles discussed in detail in U.S. Pat. No. 3,919,540, owned by the assignee of the present invention, which patent is here and incorporated by reference and made a part hereof. The safety switch is triggered to preclude damaging interference between the light fixture and equipment carried by the bed.

The service outlets, outlet support means and integrally supported service outlets possess a flexibility according to the present invention which permits them to be alternatively mounted or attached to one or more receiving means positioned at locations remote from the service outlet wall of the present invention. For example, an outlet, or a support for a service outlet device such as a monitor or an integrally supported device such as an I.V. pole, can be removed from the rail and attached directly to the headboard of a bed, to a sideguard, to a bed footboard or bed rail, to another piece of patient room furniture or to a separate mounted rail or movable device which is configured in a manner similar to or identical to the profile of the horizontal rail. In this fashion, the services provided to the patient may be brought directly to the bedside or to other remote locations in the room. Alternatively, services may be disconnected from the service outlet wall of the present invention and attached to other sources integrated into or associated with the patient bed. In this fashion, patient transfer and the time associated with preparing patient for transfer may be greatly facilitated.

This may be of value in the transport of critically ill patients whose life support equipment travels with them to and from intensive care units. Infusion pumps, drainage, portable monitors and ventilators can transport with the patient, and in some instances, then be demounted from the bed and remounted to the headwall. It may also be advantageous to position medical gas regulators at specific stations around the bed to minimize lengths of tubing to the patient. The rail mounted gas outlet blocks could be attached at such bed stations by the use of an intermediate hose extension coupling between the gas outlet block on the headwall rail and a gas outlet block mounted to the bed.

In other embodiments of the present invention, the at least one generally planar wall member of the service outlet wall according to the present invention comprises a plurality of wall members forming a column, wherein at least one of said wall members comprises said at least one generally linear section of the vertical wall and wherein said at least one service conduit is housed in the interior area formed by the plurality of wall members. Alternatively, the service outlet wall according to the present invention can be configured to form a penninsula, where at least one wall member forms at least a portion of one room wall and were in a plurality of wall members form a penninsula attached to the wall member. In this embodiment, at least one of the plurality of wall members comprises the at least one generally linear section of the wall and the at least one service conduit is housed in the interior area formed by the plurality of wall members. Penninsula and island configurations may be combined with one or more headwall units to form, e.g., the neo-natal unit described above. The rails employed in the service outlet wall of the present invention may be suspended above the floor and below the ceiling of a room and supported at least in part by one or more headwall units employed with the service outlet wall of the present invention. Alternatively, the rails may be supported at least in part by other columnar members.

When the service outlet wall of the present invention is located adjacent the electrically operated bed, e.g., a hospital patient bed, it is desirable to incorporate a safety switch means carried by at least one rail in the service outlet wall for precluding damaging interference between equipment carried by the bed and the at least one rail. This may be accomplished by mounting the rail in a movable fashion to the generally vertical wall. A safety switch means incorporated in the rail and functioning either independently or in cooperation with the generally vertical wall is triggered by movement of the rail when contacted by the bed. The safety switch is connected back to the bed to disengage power to the bed when the safety switch is triggered. The safety switch may function, e.g., in the fashion that generally described in U.S. Pat. No. 3,919,540, which is incorporated herein by reference.

Various portions of the service outlet wall of the present invention may be adapted to perform additional functions. For example, the top portion of one of the rails employed in the present invention, e.g., the U-shaped portion of the rail shown in FIG. 1, may be employed to house room lighting. For example, a series of flourescent lights could be housed in the U-shaped trough and the rail block configured to move in the trough while avoiding the flourescent light fixtures.

The preferred location of the center rail employed in embodiments of the present invention where multiple rails are used approximately 45 inches off the floor of the room. The height facilitates visibility for nursing staff and access to service outlets. This height also provides safe interface with electronic patient beds when raised to their high position. The preferred height of the lowest rail is approximately 12 inches off of the room floor and the preferred height of the top level rail is approximately 67 inches above the room floor. The preferred width of the rail employed in the service outlet wall of the present invention is approximately 2½ inches to 3 inches from the mounting wall to the front face of the rail. The rail may be of a fixed width or may be adjustable in some convenient fashion.

Although the present invention has been described in connection with the preferred embodiments thereof, it will be appreciated by those skilled in the art that additions, modifications, substitutions and deletions not specifically described may be made without departing from the spirit and scope of the invention as to find in the appended claims;

What is claimed is:

1. A vertical service outlet wall comprising:

(a) at least one generally planar vertical wall member;

(b) at least one service outlet;

(c) at least one generally linear section of said wall member defining first guide surface means arranged to receive and movably support said at least one service outlet;

(d) at least one service conduit connecting said at least one service outlet to a service source and being of a length sufficient to accommodate movement of said at least one service outlet to different portions along said linear section;

(e) means for housing said at least one service conduit connecting said at least one service outlet to a service source, said housing means being adjacent said at least one generally linear section and being configured to conceal and protect said at least one service conduit; and (f) said at least one service outlet including second guide surface means mateable with and movable along said first guide surface means so that said at least one service outlet is movable along said at least one generally linear section to permit placement of said at least one service outlet at different positions along said at least one generally linear section and to simultaneously reposition said at least one service conduit connected to said at least one service outlet within said housing to maintain said at least one service conduit in a concealed and protected condition.

2. The service outlet wall according to claim 1 wherein:

(a) said at least one generally linear section of said wall member comprises a horizontal opening in said wall positioned at a location intermediate the upper and lower ends of said vertical wall to receive and support at least one service outlet;

(b) said service conduit housing means comprises an enclosed area adjacent the back side of said vertical wall and adjacent said horizontal opening;

(c) said at least one service outlet is configured to be mounted on the said vertical wall on the bottom edge of the horizontal opening in said wall member; and (d) said at least one service outlet is slidable along the bottom edge of said horizontal opening to permit said at least one service outlet to be positioned along said edge, said at least one service conduit being movable to be simultaneously repositioned in said enclosed area to maintain said at least one service conduit is a concealed and protected condition after repositioning.

3. The service outlet wall according to claim 1 wherein said at least one generally linear section of said wall member is horizontal.

4. The service outlet wall according to claim 1 wherein said at least one generally planar vertical wall member comprises a plurality of vertical wall members forming a column, wherein at least one of said wall members comprises said at least one generally linear section and wherein said at least one service conduit is housed in the interior area formed by said plurality of wall members.

5. The service outlet wall according to claim 1 wherein said at least one generally linear section of said wall member comprises a plurality of generally linear, parallel and spaced apart sections.

6. The service outlet wall according to claim 5 wherein at least one of said generally linear sections is of a length different from the length of the other said generally linear section.

7. The service outlet wall according to claim 1 wherein said at least one generally planar vertical wall member comprises (a) at least one vertical wall member which forms at least a portion of one room wall and (b) a plurality of vertical wall members forming a penninsula attached to said at least one wall member, wherein at least one of said plurality of wall members comprises said at least one generally linear section and wherein said at least one service conduit is housed in the interior area formed by said plurality of wall members.

8. The service outlet wall according to claim 7 further comprising at least one vertical headwall unit which encloses a portion of said service conduits, said at least one headwall unit being located adjacent said at least one generally linear section.

9. The service outlet wall according to claim 1 wherein:

(a) said at least one generally linear section of said wall member comprises at least one rail having at least one generally linear support section configured to receive and support said at least one service outlet;

(b) said service conduit housing means comprises at least one trough adjacent said support section;

(c) said at least one service outlet is configured to be mounted on said support section; and (d) said at least one service outlet is slidable along said support section to permit said at least one service outlet to be positioned along said support section, said at least one service conduit being movable to be simultaneously repositioned in said trough to maintain said at least one service conduit in a concealed and protected condition after repositioning.

10. The service outlet wall according to claim 9 further comprising at least one service conduit retracting means which cooperates with said at least one service conduit to permit said conduit and said at least one service outlet connected to said conduit to be simultaneously repositioned in said at least one trough and along said at least one rail.

11. The service outlet wall according to claim 10 wherein said at least one service conduit retracting means comprises at least one movable pulley.

12. The service outlet wall according to claim 1 further comprising at least one headwall unit located adjacent said at least one generally linear section of said wall member, said at least one headwall unit configured to house said at least one service conduit.

13. The service outlet wall according to claim 12 wherein said at least one headwall unit is vertical and is configured to house one or more service outlets connected to said at least one service conduit.

14. The service outlet wall according to claim 12 wherein said at least one headwall unit is vertical and is configured to house one or more service devices connected to said at least one service conduit.

15. The service outlet wall according to claim 12 wherein said at least one generally linear section and said housing means extend into a portion of said headwall to permit service outlets to be movably positioned on said at least one generally linear section while simultaneously repositioning said at least one service conduit within said housing to maintain said conduit in a concealed and protected condition.

16. The service outlet according to claim 1 wherein:

(a) said at least one generally linear section of said wall member comprises at least one rail having at least one generally linear support section configured to receive and support said at least one service outlet;

(b) said service conduit housing means comprises an enclosed area adjacent said at least one rail;

(c) said at least one service outlet is configured to be mounted on said support section; and (d) said at least one service outlet is slidable along said support section to permit said at least one service outlet to be positioned along said support section, said at least one service conduit being movable to be simultaneously repositioned in said enclosed area to maintain said at least one service conduit in a concealed and protected condition after repositioning.

17. The service outlet wall according to claim 16 wherein said at least one service conduit is flexible and wherein the service which is provided by said at least one service conduit to said service outlet is a medical gas service.

18. The service outlet wall according to claim 16 wherein said enclosed area includes a front panel means, the top edge of which is configured to receive at least one service outlet.

19. The service outlet wall according to claim 16 wherein said at least one rail comprises a unitary structure.

20. The service outlet wall according to claim 16 wherein said at least one service outlet is positioned on said at least one rail and extends generally below said at least one rail.

21. The service outlet wall according to claim 16 wherein said at least one service conduit is a gas-carrying conduit, a liquid-carrying conduit, an electrical-carrying conduit or a solid-carrying conduit and wherein said at least one service outlet is configured to receive the same service carried by said service conduit.

22. The service outlet wall according to claim 16 wherein said at least one rail comprises a plurality of unitary structures in interlocking relation.

23. The service outlet wall according to claim 22 wherein said at least one rail comprises at least one aluminum unitary extrusion and at least one plastic unitary extrusion in interlocking relation.

24. The service outlet wall according to claim 16 wherein said enclosed area includes a front panel means movably mounted to provide access to said at least one service conduit.

25. The service outlet wall according to claim 24 wherein the top edge of said panel means is configured to receive at least one service outlet.

26. The service outlet wall according to claim 16 wherein said service outlet wall is located adjacent an electrically operated bed and further comprising a safety switch means carried by said at least one rail for precluding damaging interference between equipment carried by said bed and said at least one rail.

27. The service outlet wall according to claim 26 wherein said at least one rail is movably mounted to said generally vertical wall and wherein said safety switch means is triggered by movement of said at least one rail.

28. The service outlet wall according to claim 16 wherein the service which is provided by said at least one service conduit to said service outlet is a gas service and further comprising means for housing and concealing at least one electrical service conduit and means for supporting at least one electrical service outlet connected to said at least one electrical service conduit.

29. The service outlet wall according to claim 28 wherein said at least one electric service conduit comprises a plurality of electric service lines for providing sources of emergency power, low voltage power and standard voltage power to said at least one electrical service outlet.

30. The service outlet wall according to claim 29 wherein said at least one electrical service outlet comprises three electrical service outlets, one such outlet connected to said emergency electrical service line, one such outlet connected to said low voltage electrical service line and one such outlet connected to said standard voltage electrical service line.

31. The service outlet wall according to claim 16 wherein said enclosed area includes a front panel means movably mounted to provide access to said at least one service conduit.

32. The service outlet wall according to claim 31 wherein said front panel means is hingedly mounted.

33. The service outlet wall according to claim 32 wherein said front panel means is hingedly mounted to a second rail located generally parallel to and a distance from said first rail and having a generally linear support section configured to receive at least one service outlet.

34. The service outlet wall according to claim 33 wherein said second rail is located above said first rail.

35. The service outlet wall according to claim 33 wherein said second rail is located below said first rail.

36. The service outlet wall according to claim 16 further comprising at least one device support means attached to said rail for supporting a service device.

37. The service outlet wall according to claim 36 wherein said service device is a video display.

38. The service outlet wall according to claim 36 wherein said device support means is configured to permit alternative attachment to said at least one rail and to one or more means for receiving said device support means positioned at a location remote from said service outlet wall.

39. The service outlet wall according to claim 36 wherein said device support means is integral to said service device.

40. The service outlet wall according to claim 39 wherein said integral device support means is configured to permit alternative attachment to said at least one rail and to one or more means for receiving said device support means positioned at a location remote from said service outlet wall.

41. The service outlet wall according to claim 36 wherein said service device is a data input device.

42. The service outlet wall according to claim 41 wherein said data input device is a keyboard.

43. The service outlet wall according to claim 41 wherein said data input device is an optical scanner.

44. The service outlet wall according to claim 16 wherein said at least one rail is located in a generally horizontal position and further comprising a second rail located generally parallel to and a distance from said first rail and said second rail having at least one generally linear support section configured to receive at least one service outlet.

45. The service outlet wall according to claim 44 wherein said enclosed area includes a front panel means movably mounted to provide access to said at least one service conduit.

46. The service outlet wall according to claim 45 wherein said front panel means is hingedly mounted.

47. The service outlet according to claim 44 further comprising a third rail located generally parallel to said first and second rails and a distance from said first and second rails and having at least one generally linear support section configured to receive at least one service outlet.

48. The service outlet wall according to claim 47 wherein one of said second and third rails is located above said first rail and one is located below said first rail.

49. The service outlet wall according to claim 48 wherein said enclosed area includes a front panel means movably mounted to provide access to said at least one service conduit and positioned between two of said rails.

50. The service outlet wall according to claim 49 wherein said front panel means is hingedly mounted.

51. The service outlet wall according to claim 50 wherein said front panel means is hingedly mounted to said rail located above said first rail.

52. The service outlet wall according to claim 50 wherein said front panel means is hingedly mounted to said rail located below said first rail.

53. The service outlet wall according to claim 16 further comprising at least one additional rail having at least one generally linear support section configured to receive at least one service outlet, at least one additional service conduit connecting said at least one service outlet to a service source, at least one additional enclosed area adjacent the back side of said vertical wall and adjacent said at least one additional rail, at least one additional service outlet configured to be mounted on said support section, said at least one additional service outlet being slidable along said support section to permit said at least one additional service outlet to be positioned along said support section, said at least one additional service conduit being movable to be simultaneously repositioned in said at least one additional enclosed area to maintain said at least one service conduit in a concealed and protected condition after repositioning.

54. The service outlet wall according to claim 53 further comprising a safety light assembly mounted to one of said rails, said safety light assembly comprising a light fixture adapted to be mounted to said rail and above an electrically operated bed, and a safety switch means carried by said light fixture for precluding damaging interference between said light fixture and equipment carried by said bed.

55. The service outlet wall according to claim 53 further comprising at least one vertical headwall unit which encloses a portion of said service conduits, said at least one headwall unit being located adjacent said rails.

56. The service outlet wall according to claim 55 wherein at least one rail and associated at least one service conduit, at least one enclosed area and at least one service outlet are located on opposite sides of said at least one headwall unit.

57. The service outlet wall according to claim 55 comprising a plurality of vertical headwall units.

58. The service outlet wall according to claim 55 wherein said at least one headwall unit, said rails and said enclosed area form a penninsula attached to one wall of a room.

59. The service outlet wall according to claim 58 wherein said rails and said enclosed area are suspended above the floor and below the ceiling of said room and supported at least in part by said at least one headwall unit.

60. The service outlet wall according to claim 55 wherein said at least one headwall unit, said rails and said enclosed area form an island located in a room.

61. The service outlet wall according to claim 60 wherein said rails and said enclosed area are suspended above the floor and below the ceiling of said room and supported at least in part by said at least one headwall unit.

62. The service outlet wall according to claim 16 wherein said at least one service conduit comprises a flexible section and a rigid section.

63. The service outlet wall according to claim 62 wherein the rigid section of said at least one service conduit comprises rigid piping and wherein said rigid piping terminates behind said vertical wall.

64. The service outlet wall according to claim 63 wherein said flexible section comprises flexible hose and wherein said rigid piping is connected to said flexible hose by manifold block or junction box.

65. The service outlet wall according to claim 62 wherein said rigid section of said at least one service conduit comprises piping and wherein said rigid piping is enclosed in a vertical headwall unit located adjacent said at least one rail.

66. The service outlet wall according to claim 65 wherein said flexible section comprises flexible hose and wherein said rigid piping is connected to said flexible hose by a manifold block or junction box.

67. The service outlet wall according to claim 66 wherein said rigid piping is enclosed in said vertical headwall unit and extends beyond said headwall unit into said enclosed area and said manifold block or junction box is located in said enclosed area.

68. The service outlet wall according to claim 66 wherein said rigid piping and said manifold block or junction box are enclosed in said vertical headwall unit and are connected to said flexible hose by one or more hose fittings mounted in said headwall unit.

69. The service outlet wall according to claim 68 wherein said flexible hose is suspended in a position generally parallel to said at least one rail and is supported at a point located intermediate the ends of said at least one rail in a manner such that said hose may be directed to positions on said at least one rail where said at least one service outlet is located, said hose being of lengths sufficient to permit simultaneous repositioning of said hose and said at least one service outlet.

70. The service outlet wall according to claim 69 wherein said at least one rail and said hose are located in a generally horizontal position.

71. The service outlet wall according to claim 70 wherein said service outlet wall is mounted on a vertical room wall and is positioned at a location intermediate the upper and lower edges of said room wall.

72. The service outlet wall according to claim 71 wherein said service outlet wall extends the full length of said room wall.

73. A rail system for providing service outlets to a vertical wall in a particular location in a room while simultaneously positioning a service conduit connected to said outlets comprising:

(1) at least one support section configured to receive and support at least one movable service outlet;

(2) means for housing at least one service conduit including a flexible conduit section for connecting said at least one movable service outlet to a service supply, said housing means being adjacent said at least one support section and being configured to conceal and protect said at least one flexible conduit section when said at least one movable service outlet and said at least one flexible conduit section are simultaneously repositioned along said at least one support section; said rail being adapted to be mounted on a support surface located in said room.

74. The rail system according to claim 73 wherein said support section is generally linear and wherein said flexible conduit section is disposed with a trough adjacent said support section.

75. The rail system according to claim 73 further comprising at least one additional means for housing at least one service conduit for connecting at least one additional, fixed service outlet to a service source.

76. The rail system according to claim 75 wherein said at least one support section is generally linear and wherein said at least one additional housing means comprises one or more generally linear channels parallel to said at least one support section.

77. The rail system according to claim 73 wherein said support section is generally linear and wherein said service conduit housing means comprises an enclosed area adjacent said support section.

78. The rail system according to claim 77 wherein said enclosed area includes a front panel means, the top edge of which is configured to receive at least one movable service outlet.

79. The rail system according to claim 77 wherein said enclosed area includes a front panel means movably mounted to provide access to said at least one service conduit.

80. The rail system according to claim 79 wherein the top edge of said panel means is configured to receive at least one service outlet.

* * * * *